US008004482B2

(12) United States Patent
Lee et al.

(10) Patent No.: US 8,004,482 B2
(45) **Date of Patent: *Aug. 23, 2011**

(54) APPARATUS FOR DRIVING LIQUID CRYSTAL DISPLAY DEVICE BY MIXING ANALOG AND MODULATED DATA VOLTAGE

(75) Inventors: Seok Woo Lee, Seoul (KR); Nam Hee Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 799 days.

This patent is subject to a terminal disclaimer.

(21) Appl. No.: 11/434,595

(22) Filed: May 15, 2006

(65) Prior Publication Data

US 2007/0085810 A1 Apr. 19, 2007

(30) Foreign Application Priority Data

Oct. 14, 2005 (KR) ..... 10-2005-0097131

(51) Int. Cl.
*G09G 3/36* (2006.01)

(52) U.S. Cl. ..... 345/87; 341/144; 345/90; 345/94

(58) Field of Classification Search ..... 341/126, 341/144

See application file for complete search history.

(56) References Cited

U.S. PATENT DOCUMENTS 5,831,588 A * 11/1998 Hotto ..... 345/100
6,127,993 A * 10/2000 Ohba et al. ..... 345/77
6,414,666 B1 7/2002 Yamakawa et al.
6,642,915 B1 * 11/2003 Booth et al. ..... 345/90
2003/0048246 A1 3/2003 Ham
2003/0048247 A1 3/2003 Ham
2003/0071778 A1 * 4/2003 Lee et al. ..... 345/98
2003/0128176 A1 * 7/2003 Ham ..... 345/87
2005/0156852 A1 7/2005 Kwon
2005/0264222 A1 * 12/2005 Lee et al. ..... 315/160
2006/0197733 A1 * 9/2006 Lee et al. ..... 345/100

FOREIGN PATENT DOCUMENTS

CN 1407531 4/2003

(Continued)

OTHER PUBLICATIONS

First Office Action for corresponding Chinese Patent Application Serial No. 2006100903047, dated Nov. 30, 2007.

(Continued)

*Primary Examiner* — Amare Mengistu
*Assistant Examiner* — Antonio Xavier
(74) *Attorney, Agent, or Firm* — Brinks Hofer Gilson & Lione

(57) ABSTRACT

An apparatus and method for driving a liquid crystal display device are disclosed in which the response speed of the liquid crystal can be increased without using a digital memory. The driving apparatus includes a liquid crystal panel with gate lines and data lines arranged perpendicularly to each other, a gate driver that supplies a gate pulse to the gate lines, and a data driver. The data driver samples an input N-bit digital data signal to generate an analog data voltage, generates a modulated data voltage for acceleration of a response speed of the liquid crystal according to an M-bit data value of the sampled digital data signal, mixes the modulated data voltage with the analog data voltage, and supplies the mixed data voltage to the data lines.

18 Claims, 19 Drawing Sheets

FOREIGN PATENT DOCUMENTS

| | | | |
|---|---|---|---|
| DE | 102 24 564 | A1 | 5/2003 |
| DE | 10 2005 048 206 | A1 | 9/2006 |
| GB | 2424115 | | 9/2006 |
| JP | 51-56942 | | 5/1976 |
| JP | 06-067154 | | 3/1994 |
| JP | 06-110414 | | 4/1994 |
| JP | 09-185345 | | 7/1997 |
| JP | 2001-125546 | | 5/2001 |
| JP | 2003-143023 | | 5/2003 |
| JP | 2004-109796 | | 4/2004 |
| JP | 2004-341357 | | 12/2004 |
| JP | 2005-099170 | | 4/2005 |
| KR | 1020040059319 | A | 7/2004 |
| TW | 522370 | | 3/2003 |
| TW | 571279 | | 1/2004 |
| WO | 2004/013835 | A1 | 2/2004 |

OTHER PUBLICATIONS

Search Report dated May 11, 2007 for corresponding Great Britain Patent Application No. GB0612961.3.

Office Action issued in corresponding German Patent Application No. 10 2006 029 421.1; issued Sep. 22, 2008.

Combined Search and Examination Report dated Oct. 24, 2006 for corresponding United Kingdom Patent Application No. GB0612961.3.

Office Action issued in corresponding Japanese Patent Application No. 2006-171054; issued Apr. 5, 2010.

Office Action issued in corresponding Japanese Patent Application No. 2006-171054; issued May 14, 2009.

Office Action issued in corresponding Japanese Patent Application No. 2006-171054; issued Sep. 14, 2009.

Office Action issued in corresponding Japanese Patent Application No. 2006-171054; mailed May 18, 2009.

* cited by examiner

APPARATUS FOR DRIVING LIQUID CRYSTAL DISPLAY DEVICE BY MIXING ANALOG AND MODULATED DATA VOLTAGE

This application claims the benefit of priority to Korean Patent Application No. P2005-97131 filed on Oct. 14, 2005, herein incorporated by reference.

TECHNICAL FIELD

The technical field relates to a liquid crystal display (LCD) device, and more particularly, to an apparatus and method for driving a liquid crystal display device, wherein the response speed of a liquid crystal is increased without using a memory, thereby preventing degradation in picture quality.

DISCUSSION OF THE RELATED ART

Liquid crystal display devices have been used in many different types of electronic equipment. Liquid crystal display devices adjust light transmittance of liquid crystal cells according to a video signal so as to display an image. An active matrix type liquid crystal display device has a switching element formed for every liquid crystal cell and is suitable for the display of a moving image. A thin film transistor (TFT) is mainly used as the switching element in the active matrix type liquid crystal display device.

However, the liquid crystal display device has a relatively slow response speed due to characteristics such as the inherent viscosity and elasticity of a liquid crystal, as shown in the following Equations 1 and 2:

$$\tau_r \propto \frac{\gamma d^2}{\Delta\varepsilon |Va^2 - V_F^2|} \quad \text{[Equation 1]}$$

where $\tau_r$ is a rising time when a voltage is applied to the liquid crystal, Va is the applied voltage, $V_F$ is a Frederick transition voltage at which liquid crystal molecules start to be inclined, d is a liquid crystal cell gap, and $\gamma$ is the rotational viscosity of the liquid crystal molecules.

$$\tau_F \propto \frac{\gamma d^2}{K} \quad \text{[Equation 2]}$$

where $\tau_F$ is a falling time when the liquid crystal is returned to its original position due to an elastic restoration force after the applied voltage of the liquid crystal is turned off, and K is the inherent elastic modulus of the liquid crystal.

In a twisted nematic (TN) mode, although the response speed of the liquid crystal may be different according to the physical properties and cell gap of the liquid crystal, it is common that the rising time is 20 to 80 ms and the falling time is 20 to 30 ms. Because this liquid crystal response speed is longer than one frame period (16.67 ms in National Television Standards Committee (NTSC)) of a moving image, the response of the liquid crystal proceeds to the next frame before a voltage being charged on the liquid crystal reaches a desired level, as shown in FIG. 1, resulting in motion blurring in which an afterimage is left in the eyeplane.

With reference to FIG. 1, a conventional liquid crystal display device cannot express a desired color and brightness for display of a moving image in that, when data VD is changed from one level to another level, the corresponding display brightness level BL is unable to reach a desired value due to the slow response of the liquid crystal display device. As a result, motion blurring occurs in the moving image, causing degradation in contrast ratio and, in turn, degradation in display quality.

In order to solve the low response speed of the liquid crystal display device, U.S. Pat. No. 5,495,265 and PCT International Publication No. WO 99/09967 proposed a method for modulating data according to a variation therein using a look-up table (referred to hereinafter as a 'high-speed driving method'). This high-speed driving method is adapted to modulate data on the basis of a principle as shown in FIG. 2.

With reference to FIG. 2, the conventional high-speed driving method includes modulating input data VD and applying the modulated data MVD to a liquid crystal cell to obtain a desired brightness level MBL. In order to obtain the desired brightness level corresponding to the luminance of the input data in one frame period in this high-speed driving method, the response of a liquid crystal is rapidly accelerated by increasing $|Va^2-V_F^2|$ in the Equation 1 on the basis of a variation in the input data.

Accordingly, a conventional liquid crystal display device using the high-speed driving method is able to compensate for the slow response of a liquid crystal by modulating the data value to reduce motion blurring in a moving image, thereby displaying a picture with a desired color and brightness.

As shown in FIG. 3, to reduce the memory capacity burden in the hardware implementation, the conventional high-speed driving method performs modulation by comparing respective most significant bits MSB of a previous frame Fn−1 and current frame Fn with each other. To clarify, the conventional high-speed driving method compares respective most significant bit data MSB of the previous frame Fn−1 and current frame Fn with each other to determine whether there is a variation between the two most significant bit data MSB. If there is a variation between the two most significant bit data MSB, the corresponding modulated data MRGB is selected from a look-up table as most significant bit data MSB of the current frame Fn.

FIG. 4 shows the configuration of a conventional high-speed driving apparatus implementing the aforementioned high-speed driving method.

With reference to FIG. 4, the conventional high-speed driving apparatus comprises a frame memory 43 connected to a most significant bit bus line 42, and a look-up table 44 connected in common to output terminals of the most significant bit bus line 42 and frame memory 43.

The frame memory 43 stores most significant bit data MSB for one frame period and supplies the stored data to the look-up table 44. Here, the most significant bit data MSB is set to four most significant bits of 8-bit source data RGB.

The look-up table 44 compares most significant bit data MSB of a current frame Fn inputted from the most significant bit bus line 42 with most significant bit data MSB of a previous frame Fn−1 inputted from the frame memory 43, as in Table 1 below, and selects modulated data MRGB corresponding to the comparison result. The modulated data MRGB is added to least significant bit data LSB from a least significant bit bus line 41 and then supplied to a liquid crystal display device.

Where the most significant bit data MSB is limited to four bits, the modulated data MRGB registered in the look-up table 44 of the high-speed driving apparatus and method is

TABLE 1

| | | Current Frame | | | | | | | | | | | | | | | |
|---|---|---|---|---|---|---|---|---|---|---|---|---|---|---|---|---|---|
| | | 0 | 1 | 2 | 3 | 4 | 5 | 6 | 7 | 8 | 9 | 10 | 11 | 12 | 13 | 14 | 15 |
| Previous Frame | 0 | 0 | 1 | 3 | 4 | 6 | 7 | 9 | 10 | 11 | 12 | 14 | 15 | 15 | 15 | 15 | 15 |
| | 1 | 0 | 1 | 2 | 4 | 5 | 7 | 9 | 10 | 11 | 12 | 13 | 14 | 15 | 15 | 15 | 15 |
| | 2 | 0 | 1 | 2 | 3 | 5 | 7 | 8 | 9 | 10 | 12 | 13 | 14 | 15 | 15 | 15 | 15 |
| | 3 | 0 | 1 | 2 | 3 | 5 | 6 | 8 | 9 | 10 | 11 | 12 | 14 | 14 | 15 | 15 | 15 |
| | 4 | 0 | 0 | 1 | 2 | 4 | 6 | 7 | 9 | 10 | 11 | 12 | 13 | 14 | 15 | 15 | 15 |
| | 5 | 0 | 0 | 0 | 2 | 3 | 5 | 7 | 8 | 9 | 11 | 12 | 13 | 14 | 15 | 15 | 15 |
| | 6 | 0 | 0 | 0 | 1 | 3 | 4 | 6 | 8 | 9 | 10 | 11 | 13 | 14 | 15 | 15 | 15 |
| | 7 | 0 | 0 | 0 | 1 | 2 | 4 | 5 | 7 | 8 | 10 | 11 | 12 | 14 | 14 | 15 | 15 |
| | 8 | 0 | 0 | 0 | 1 | 2 | 3 | 5 | 6 | 8 | 9 | 11 | 12 | 13 | 14 | 15 | 15 |
| | 9 | 0 | 0 | 0 | 1 | 2 | 3 | 4 | 6 | 7 | 9 | 10 | 12 | 13 | 14 | 15 | 15 |
| | 10 | 0 | 0 | 0 | 0 | 1 | 2 | 4 | 5 | 7 | 8 | 10 | 11 | 13 | 14 | 15 | 15 |
| | 11 | 0 | 0 | 0 | 0 | 0 | 2 | 3 | 5 | 6 | 7 | 9 | 11 | 12 | 14 | 15 | 15 |
| | 12 | 0 | 0 | 0 | 0 | 0 | 1 | 3 | 4 | 5 | 7 | 8 | 10 | 12 | 13 | 15 | 15 |
| | 13 | 0 | 0 | 0 | 0 | 0 | 1 | 2 | 3 | 4 | 6 | 8 | 10 | 11 | 13 | 14 | 15 |
| | 14 | 0 | 0 | 0 | 0 | 0 | 0 | 1 | 2 | 3 | 5 | 7 | 9 | 11 | 13 | 14 | 15 |
| | 15 | 0 | 0 | 0 | 0 | 0 | 0 | 0 | 1 | 2 | 4 | 6 | 9 | 11 | 13 | 14 | 15 |

In the above Table 1, the leftmost column represents the data voltage VDn−1 of the previous frame Fn−1 and the uppermost row represents most row represents the data voltage VDn of the current frame Fn. Table 1 also includes look-up table information obtained by expressing four most significant bits in decimal form.

In the above-mentioned high-speed driving apparatus and method, a digital memory, such as the look-up table 44, is used to generate modulated data MRGB by comparing the data of the previous frame Fn−1 and current frame Fn with each other. The use of the digital memory increases chip size as well as manufacturing costs.

BRIEF DESCRIPTION OF THE DRAWINGS

The disclosure includes the following detailed description and reference to the accompanying drawings, in which.

DETAILED DESCRIPTION

Reference will now be made in detail to the examples, which are illustrated in the accompanying drawings. Wherever possible, the same reference numbers will be used throughout the drawings to refer to the same or like parts.

Figure 1:
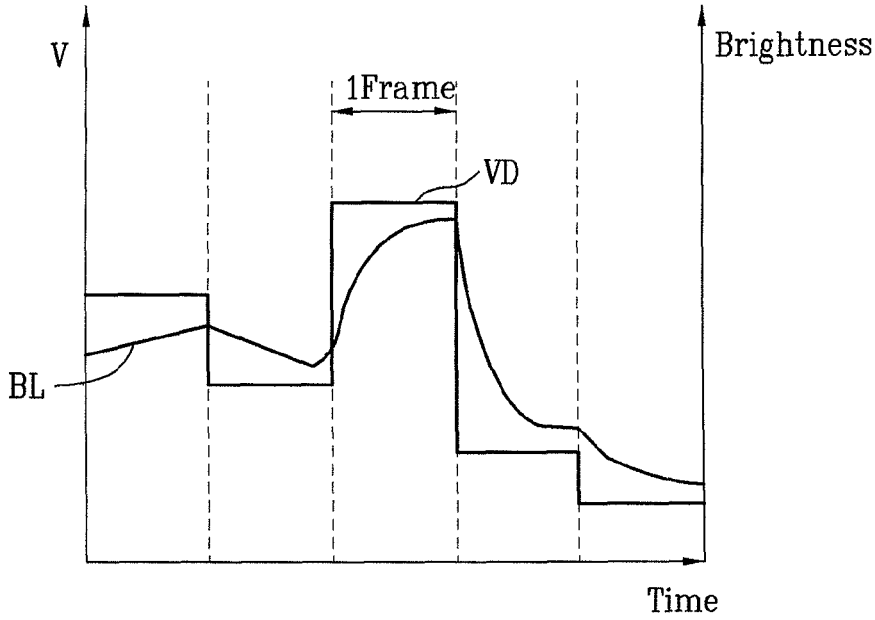
FIG. 1 Prior Art
FIG. 1 is a waveform diagram of a data-dependent brightness variation in a conventional liquid crystal display device.
Figure 2:
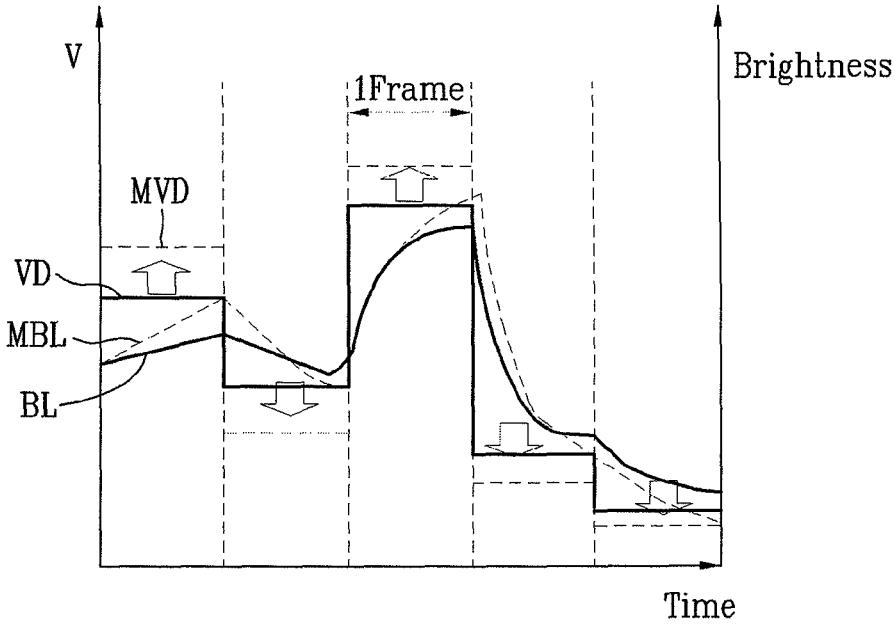
FIG. 2 Prior Art
FIG. 2 is a waveform diagram of a data modulation-dependent brightness variation of a conventional high-speed driving method.
Figure 3:
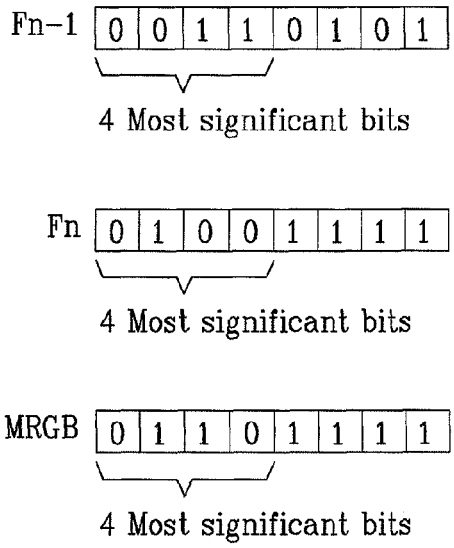
FIG. 3 Prior Art
FIG. 3 is a view of most significant bit data modulation in a conventional high-speed driving apparatus.
Figure 4:
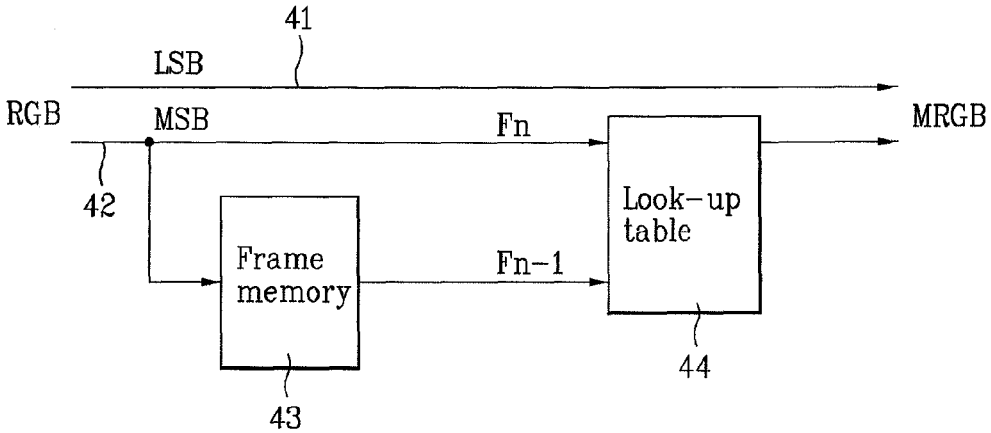
FIG. 4 Prior Art
FIG. 4 is a block diagram of the conventional high-speed driving apparatus.
Figure 5:
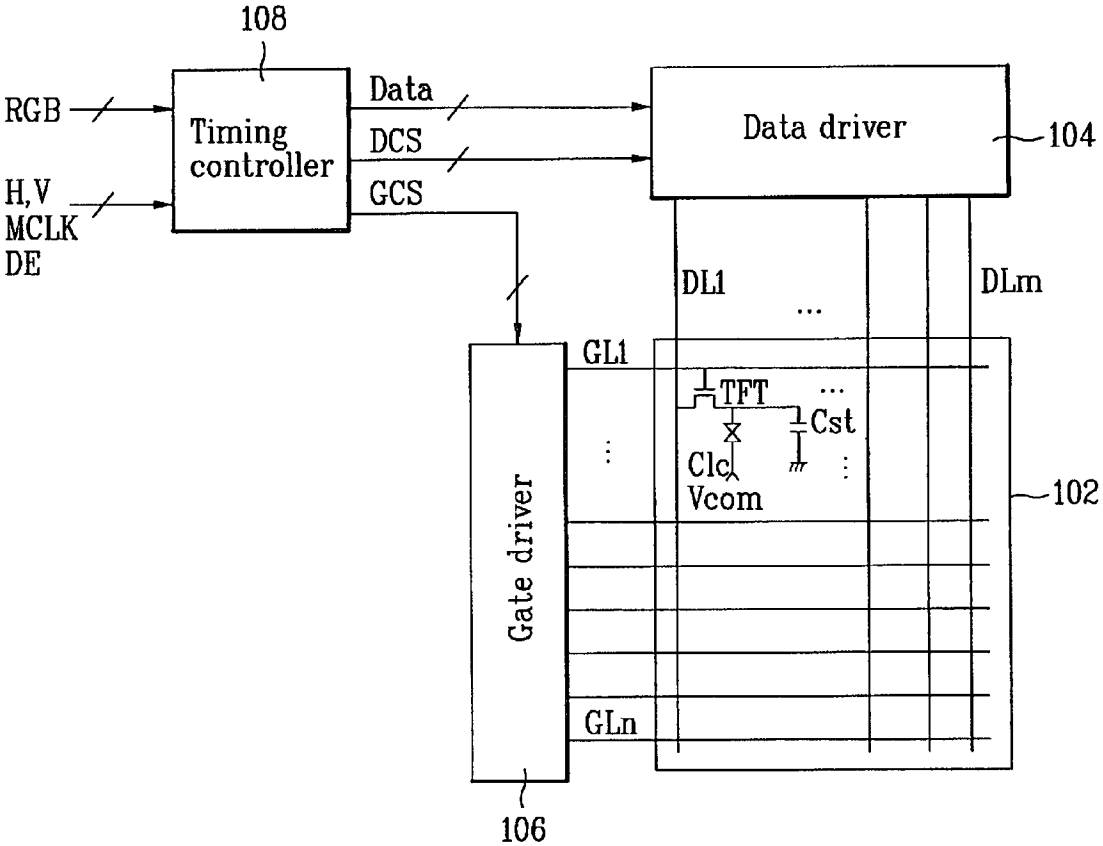
FIG. 5 is a block diagram schematically showing a configuration of a driving apparatus.

Referring first to FIG. 5, the driving apparatus of a liquid crystal display device comprises a liquid crystal panel 102 including a plurality of gate lines GL1 to GLn and a plurality of data lines DL1 to DLm arranged perpendicularly to each other for defining cell areas, a gate driver 106 for driving the gate lines GL1 to GLn of the liquid crystal panel 102, and a data driver 104 for sampling an input N-bit (where N is a positive integer) digital data signal Data. The data driver 104 is further capable of generating an analog data voltage Vdata (not shown) corresponding to the sampled N-bit digital data signal Data and generating a modulated data voltage Vmdata (not shown) for accelerating the response speed of a liquid crystal according to an M-bit (where M is a positive integer smaller than or equal to N) data value of the sampled N-bit digital data signal Data. The data driver 104 is also capable of mixing the modulated data voltage Vmdata with the analog data voltage Vdata and supplying the mixed data voltage to the data lines DL. The driving apparatus of the liquid crystal display device further comprises a timing controller 108 for controlling driving timings of the data and gate drivers (104, 106) and supplying the digital data signal Data to the data driver 104.

The liquid crystal panel 102 further includes a plurality of thin film transistors (TFTs) formed respectively at intersections of the gate lines GL1 to GLn and the data lines DL1 to DLm, and a plurality of liquid crystal cells connected respectively to the TFTs. Each TFT supplies an analog data voltage from an associated one of the data lines DL1 to DLm to an associated one of the liquid crystal cells in response to a gate pulse from an associated one of the gate lines GL1 to GLn. Each liquid crystal cell can be expressed as a liquid crystal capacitor Clc because it is provided with a common electrode facing the liquid crystal, and a pixel electrode connected to the associated TFT. This liquid crystal cell includes a storage capacitor Cst for maintaining an analog data voltage charged on the liquid crystal capacitor Clc until the next data signal is charged.

The timing controller 108 arranges source data RGB externally supplied thereto into a digital data signal Data for driving of the liquid crystal panel 102, and supplies the arranged digital data signal Data to the data driver 104. The timing controller 108 also generates a data control signal DCS and a gate control signal GCS using a main clock MCLK, a data enable signal DE, and horizontal and vertical synchronous signals Hsync and Vsync externally inputted thereto. The timing controller 108 applies the generated data control signal DCS and gate control signal GCS respectively to the data and gate drivers (104, 106) to control their driving timings.

The gate driver 106 sequentially generates and supplies a gate pulse to the gate lines GL1 to GLn in response to the gate control signal GCS from the timing controller 108 to turn the TFTs on and off. The gate control signal GCS may include a gate start pulse GSP, a gate shift clock GSC, a gate output enable signal GOE, or other similar signals. The gate pulse may include a gate high voltage VGH for turning the TFTs on, a gate low voltage VGL for turning the TFTs off, or other similar signals.

The data driver 104 samples the N-bit (where N is a positive integer) digital data signal Data from the timing controller 108 in response to the data control signal DCS and generates the analog data voltage Vdata corresponding to the sampled N-bit digital data signal Data. The data driver 104 also generates the modulated data voltage Vmdata for accelerating the response speed of the liquid crystal according to the M-bit (where M is a positive integer smaller than or equal to N) data value of the sampled N-bit digital data signal Data. The data driver 104 further mixes the modulated data voltage Vmdata with the analog data voltage Vdata and supplies the mixed data voltage to the data lines DL.

Figure 6:
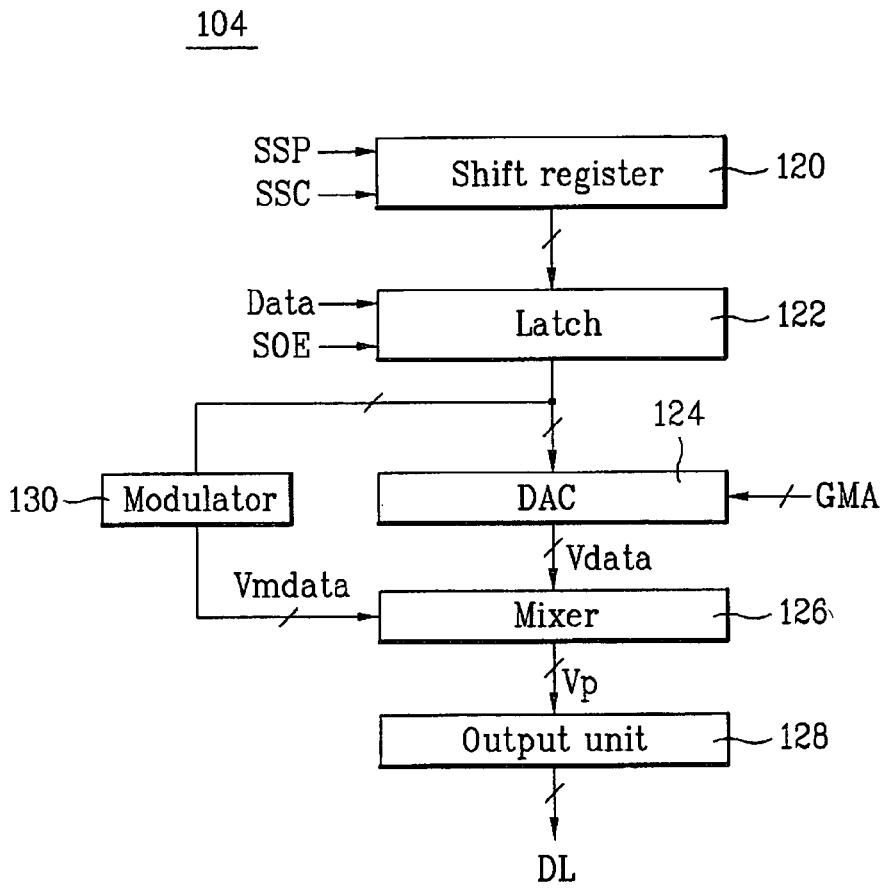
FIG. 6 is a schematic diagram of the data driver in FIG. 5.

As shown in FIG. 6, the data driver 104 includes, a shift register 120 for sequentially generating a sampling signal, a latch 122 for latching the N-bit digital data signal Data in response to the sampling signal, and a digital-to-analog converter 124 for selecting any one of a plurality of gamma voltages GMA based on the latched N-bit digital data signal Data and generating the selected gamma voltage GMA as the analog data voltage Vdata corresponding to the digital data signal Data. The data driver 104 also includes a modulator 130 for generating the modulated data voltage Vmdata for accelerating the response speed of the liquid crystal according to the M-bit data value of the latched N-bit digital data signal Data, a mixer 126 for mixing the modulated data voltage Vmdata with the analog data voltage Vdata, and an output unit 128 for buffering the mixed data voltage Vp and supplying the buffered data voltage to the data lines DL.

The shift register 120 sequentially generates and supplies the sampling signal to the latch 122 in response to a source start pulse SSP and a source shift clock SSC included in the data control signal DCS from the timing controller 108.

The latch 122 latches the N-bit digital data signal Data from the timing controller 108 in response to the sampling signal from the shift register 120 on a horizontal line-by-horizontal line basis. The latch 122 also supplies the latched N-bit digital data signal Data of one horizontal line to the digital-to-analog converter 124 in response to a source output enable signal SOE included in the data control signal DCS from the timing controller 108.

Figure 7A:
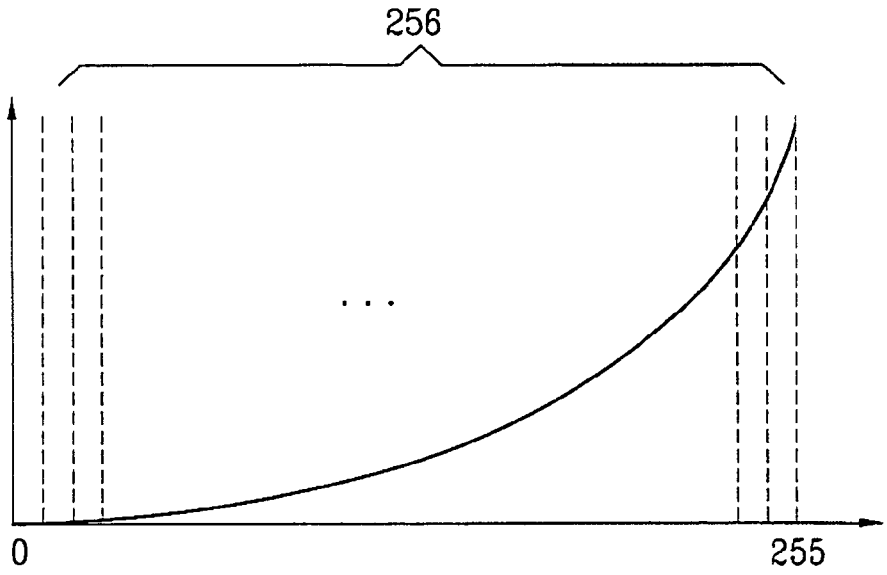
FIG. 7A is a graph of the levels of gamma voltages which are supplied to a digital-to-analog converter in FIG. 6, or the levels of modulated data voltages which are outputted from a modulator in FIG. 6.

The digital-to-analog converter 124 converts the N-bit digital data signal Data into the analog data voltage Vdata and supplies the converted analog data voltage Vdata to the mixer 126 by selecting any one of the plurality of gamma voltages GMA, which are supplied from a gamma voltage generator, not shown, according to the N-bit digital data signal Data from the latch 122. When the N-bit digital data signal Data is of 8 bits, the plurality of gamma voltages GMA have 256 different levels, as shown in FIG. 7A. In this case, the digital-to-analog converter 124 selects any one of the gamma voltages GMA of the 256 different levels corresponding to the N-bit digital data signal Data from the latch 122 and generates the selected gamma voltage as the analog data voltage Vdata.

The modulator 130 generates the modulated data voltage Vmdata for accelerating the response speed of the liquid crystal according to the digital data signal Data of the M bits from the N bits outputted from the latch 122 and supplies the generated data voltage Vmdata to the mixer 126.

In detail, the modulator 130 generates a modulated data voltage Vmdata having a different level and a different pulse width depending on the M-bit digital data signal Data supplied from the latch 122.

Figure 7B:
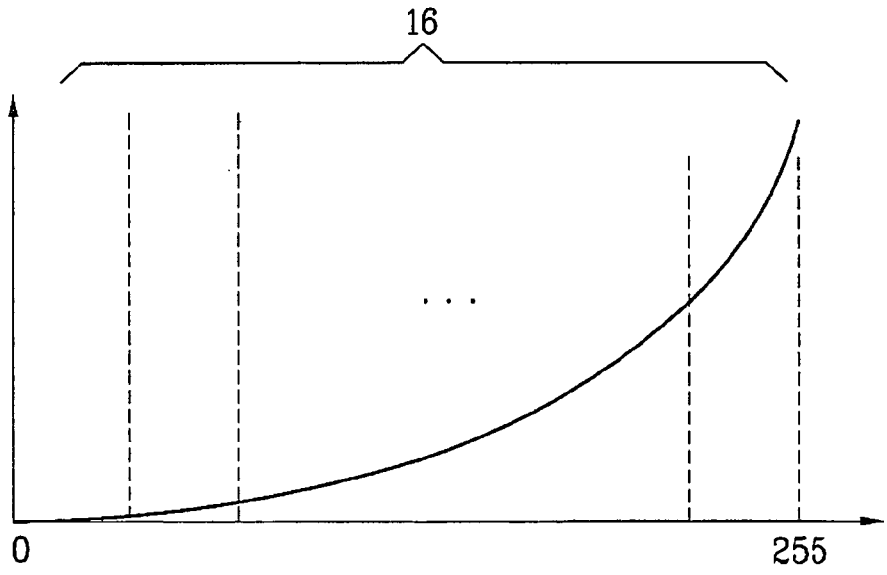
FIG. 7B is a graph of the levels of the modulated data voltages which are outputted from the modulator in FIG. 6.

When the M-bit digital data signal Data outputted from the latch 122 is 8 bits, the modulator 130 generates modulated data voltages Vmdata having 256 different levels and pulse widths. However, when the M-bit digital data signal Data inputted to the modulator 130 is 8 bits, the modulator 130 is increased in size. For this reason, it is assumed that the digital data signal Data of the four most significant bits MSB1 to MSB4 of the 8 bits outputted from the latch 122 is supplied to the modulator 130. Thus, the modulator 130 generates a modulated data voltage Vmdata having any one of 16 different levels and any one of 16 different pulse widths, as shown in FIG. 7B, on the basis of the four most significant bits MSB1 to MSB4 from the latch 122, and supplies the generated modulated data voltage Vmdata to the mixer 126.

The mixer 126 mixes the modulated data voltage Vmdata from the modulator 130 with the analog data voltage Vdata from the digital-to-analog converter 124 and supplies the mixed data voltage Vp to the output unit 128.

The output unit 128 supplies the data voltage Vp from the mixer 126 to the data lines DL.

Figure 8:
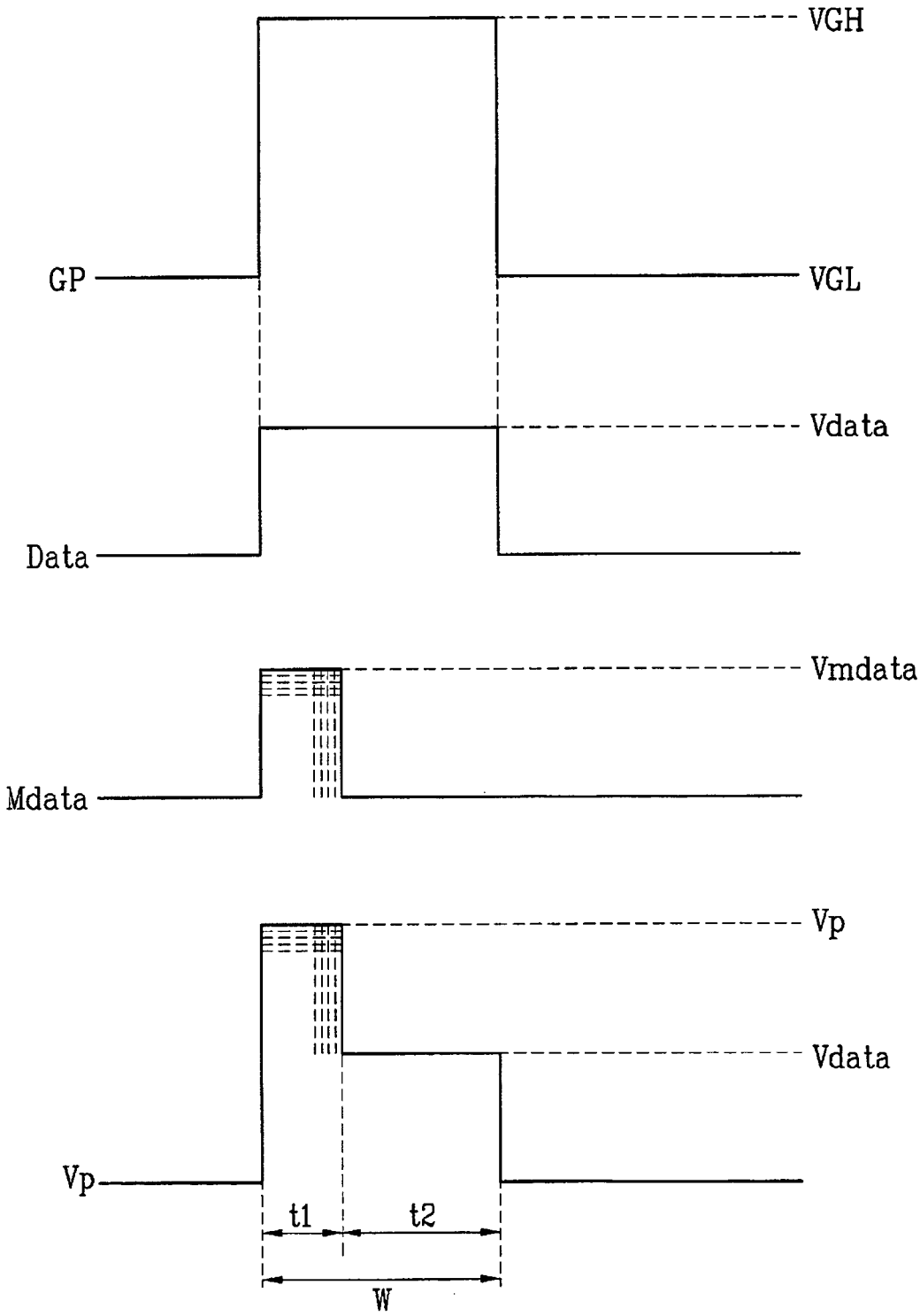
FIG. 8 is a waveform diagram of waveforms that are supplied to gate lines and data lines of a liquid crystal panel in FIG. 5.

FIG. 8 is a waveform diagram of a gate pulse GP and data voltage Vp which are supplied to the liquid crystal panel 102 in FIG. 5 for one horizontal period.

Referring to FIG. 8 in connection with FIG. 6, a gate pulse GP with a certain width W from the gate driver 106 is supplied to the gate line GL of the liquid crystal panel 102. Synchronously with this gate pulse GP, the mixer 126 supplies the mixed data voltage Vp of the analog data voltage Vdata from the digital-to-analog converter 124 and the modulated data voltage Vmdata from the modulator 130 to the data line DL of the liquid crystal panel 102 for a first period t1 of the gate pulse GP in which a gate high voltage VGH is supplied to the gate line. Then, the analog data voltage Vdata from the digital-to-analog converter 124 is supplied to the data line DL of the liquid crystal panel 102 for a second period t2 of the gate pulse GP subsequent to the first period t1 in which the gate high voltage VGH is supplied to the gate line. Preferably, the first period t1 is shorter than the second period t2.

Therefore, in the driving apparatus and method of the liquid crystal display device, the liquid crystal is pre-driven with a voltage higher than the analog data voltage Vdata by supplying the data voltage Vp and the modulated data voltage Vmdata to the data line DL in the first period t1 of the gate pulse GP which is supplied to the gate line GL. The liquid crystal is then driven in a desired state by supplying an analog data voltage Vp of a desired gray scale to the data line DL in the second period t2 of the gate pulse GP. To clarify, in the driving apparatus and method of the liquid crystal display device according to the embodiment of the present invention, the liquid crystal is driven at high speed with the mixed data voltage of the modulated data voltage Vmdata and analog data voltage Vdata in the first period t1 of the scan period of the liquid crystal panel 102, and then normally driven with the analog data voltage Vdata in the second period t2 subsequent to the first period t1.

Hence, in the driving apparatus and method of the liquid crystal display device, it is possible to increase the response speed of the liquid crystal even without using a separate memory, so as to prevent degradation in picture quality.

FIG. 8 shows one example of the modulator $_0$ 30 in the driving apparatus of the liquid crystal display device shown in FIGS. 5 and 6.

Referring to FIG. 8 in connection with FIG. 6, the modulator $_0$ 30 includes a modulated voltage generator $_0$ 32 for generating the modulated data voltage Vmdata having the different level according to a 4-most significant bit digital data signal ($MSB_0$ to MSB4) from the latch $_0$ 22, a switching control signal generator $_0$ 34 for generating a switching control signal SCS having a different pulse width according to the 4-most significant bit digital data signal ($MSB_0$ to MSB4) from the latch $_0$ 22, and a switch $_0$ 36 for supplying the modulated data voltage Vmdata from an output node $n_0$ of the modulated voltage generator $_0$ 32 to the mixer $_0$ 26 in response to the switching control signal SCS.

The modulated voltage generator $_0$ 32 includes a first decoder $_0$ 40 for decoding the 4-most significant bit digital data signal ($MSB_0$ to MSB4) from the latch $_0$ 22 and outputting the decoded signal at a plurality of output terminals, a plurality of voltage-dividing resistors $R_0$ to $R_0$ 6 connected respectively to the output terminals of the first decoder $_0$ 40, and a first resistor Rv electrically connected between a drive voltage terminal VDD and each of the voltage-dividing resistors $R_0$ to $R_0$ 6.

The voltage-dividing resistors R1 to R16 have different resistances and are electrically connected between the output node n1 and the corresponding output terminals of the first decoder 140. The first resistor Rv and the plurality of voltage-dividing resistors R1 to R16 constitute a voltage divider circuit for setting the level of a data voltage modulated by the decoding of the first decoder 140.

The first decoder 140 decodes the 4-most significant bit digital data signal (MSB1 to MSB4) from the latch 122 to selectively connect any one of the plurality of voltage-dividing resistors R1 to R16 to an internal ground voltage source. As a result, the drive voltage VDD is divided by the first resistor Rv and the selectively connected voltage-dividing resistor and the divided voltage appears at the output node n1 as the modulated data voltage Vmdata. The modulated data voltage Vmdata can be expressed by the following Equation 3:

$$Vmdata = \frac{Rx}{Rv + Rx} \times VDD \qquad \text{[Equation 3]}$$

In Equation 3, Rx is any one of the plurality of voltage-dividing resistors R1 to R16.

In this manner, the modulated voltage generator 132 supplies the modulated data voltage Vmdata with the different level to the switch 136 by selectively connecting any one of the plurality of voltage-dividing resistors R1 to R16 to the internal ground voltage source according to the 4-most significant bit digital data signal (MSB1 to MSB4) from the latch 122.

The switching control signal generator 134 includes a second decoder 142 for decoding the 4-most significant bit digital data signal (MSB1 to MSB4) from the latch 122, and a counter 144 for counting a clock signal CLK correspondingly to the decoded signal from the second decoder 142 to generate the switching control signal SCS with the different pulse width, and supplying the generated switching control signal SCS to the switch 136 synchronously with the source output enable signal SOE.

The second decoder 142 decodes the 4-most significant bit digital data signal (MSB1 to MSB4) from the latch 122 and supplies the resulting decoded signal with a different value to the counter 144.

The counter 144 counts the clock signal CLK by the decoded value from the second decoder 142 to generate the switching control signal SCS having the pulse width corresponding to the decoded value. The counter 144 then supplies the generated switching control signal SCS to the switch 136 synchronously with the source output enable signal SOE. Alternatively, the counter 144 may supply the generated switching control signal SCS to the switch 136 synchronously with the gate pulse GP.

The switch 136 is turned on in response to the switching control signal SCS from the counter 144 in switching control signal generator 134 to supply the modulated data voltage Vmdata from the output node n1 of the modulated voltage generator 132 to the mixer 126. Then, the switch 136 supplies the modulated data voltage Vmdata to the mixer 126 for a period corresponding to the pulse width of the switching control signal SCS.

In this first example, the modulator 130 generates the modulated data voltage Vmdata and the switching control signal SCS according to the 4-most significant bit digital data signal (MSB1 to MSB4) from the latch 122 and sets the level and pulse width of the modulated data voltage Vmdata supplied to the mixer 126.

Therefore, in the driving apparatus and method of the liquid crystal display device including the modulator 130, the liquid crystal is driven at high speed with the mixed data voltage of the modulated data voltage Vmdata with a level and pulse width corresponding to the M-bit digital data signal Data and the analog data voltage Vdata in the first period t1 of the scan period of the liquid crystal panel 102, and then normally driven with the analog data voltage Vdata in the second period t2 subsequent to the first period t1.

The modulator 130 may further include a buffer, not shown, disposed between the output node n1 of the modulated voltage generator 132 and the switch 136. The buffer buffers the modulated data voltage Vmdata from the output node n1 of the modulated voltage generator 132 and supplies the buffered data voltage to the switch 136.

Although the modulator 130 may use the four most significant bits of the 8-bit digital data signal Data outputted from the latch 122, it is not limited thereto. For example, the modulator 130 may generate and supply the modulated data voltage Vmdata with the different level and pulse width to the mixer 126 according to the 4-most significant bits all the way up to the full 8-bit digital data signal Data.

Figure 10:
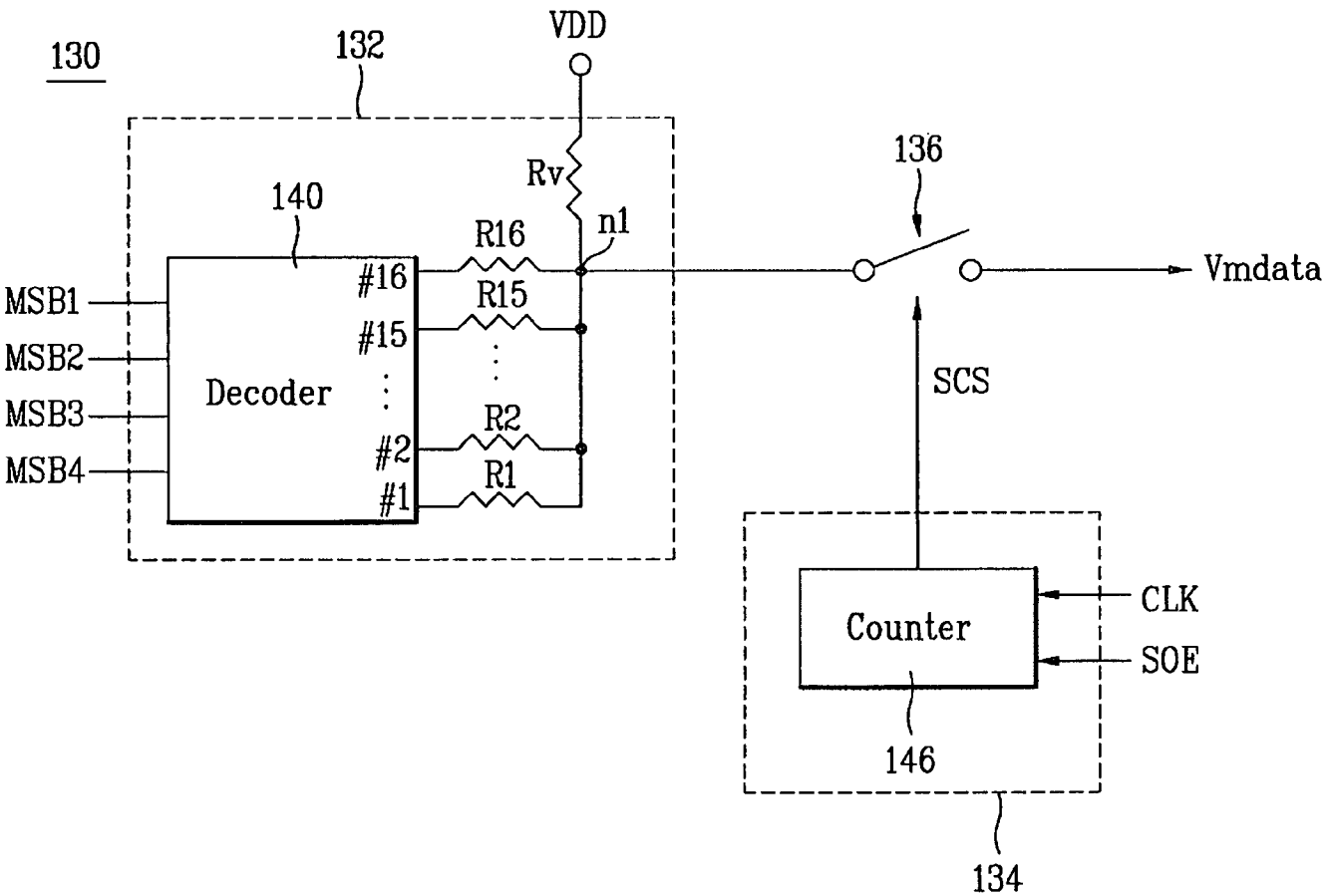
FIG. 10 is a view showing another example of the modulator in FIG. 6.

FIG. 10 shows another example of the modulator 130 in the driving apparatus of the liquid crystal display device shown in FIGS. 5 and 6.

Figure 9:
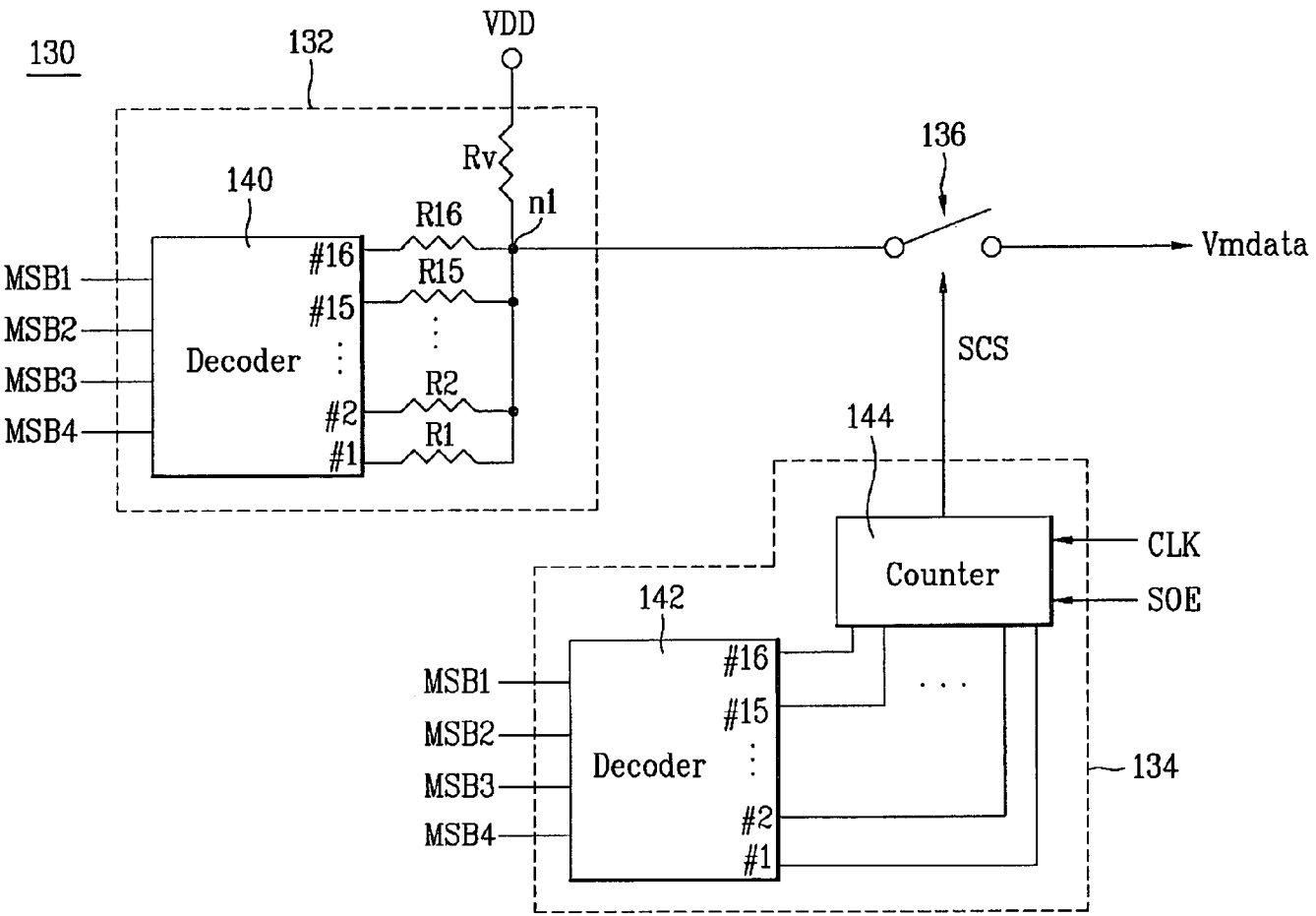
FIG. 9 is a view showing one example of the modulator in FIG. 6.

Referring to FIG. 10 in connection with FIG. 6, the modulator 130 may be similar in construction as that shown in FIG. 9. Therefore, a description will be omitted of similar components. As shown in FIG. 10, the modulator 130 may also include a switching control signal generator 134.

The switching control signal generator 134 of the modulator 130 includes a counter 146 for counting the clock signal CLK up to a predetermined value to generate a switching control signal SCS with a fixed pulse width. The counter 146 supplies the generated switching control signal SCS to the switch 136 synchronously with the source output enable signal SOE.

The counter 146 counts the clock signal CLK up to a predetermined value to generate the switching control signal SCS. The counter 146 then supplies the generated switching control signal SCS to the switch 136 synchronously with the source output enable signal SOE.

Alternatively, the counter 146 may supply the generated switching control signal SCS to the switch 136 synchronously with the gate pulse GP.

Hence, the switching control signal generator 134 in the modulator 130 generates the switching control signal SCS with the fixed pulse width through the use of the counter 146 to control the switch 136. As a result, a modulated data voltage Vmdata with a fixed pulse width is supplied to the mixer 126 regardless of the M-bit digital data signal Data.

Therefore, in the driving apparatus and method of the liquid crystal display device including the modulator 130 shown in FIG. 10, the liquid crystal is driven at high speed with a mixed data voltage. The mixed data voltage includes the modulated data voltage Vmdata and the analog data voltage Vdata. The modulated data voltage Vmdata has a fixed pulse width and a level corresponding to the M-bit digital data signal Data. The liquid crystal is driven at high speed with the mixed data voltage in the first period t1 of the scan period of the liquid crystal panel 102, and then normally driven with the analog data voltage Vdata in the second period t2 subsequent to the first period t1.

Figure 11:
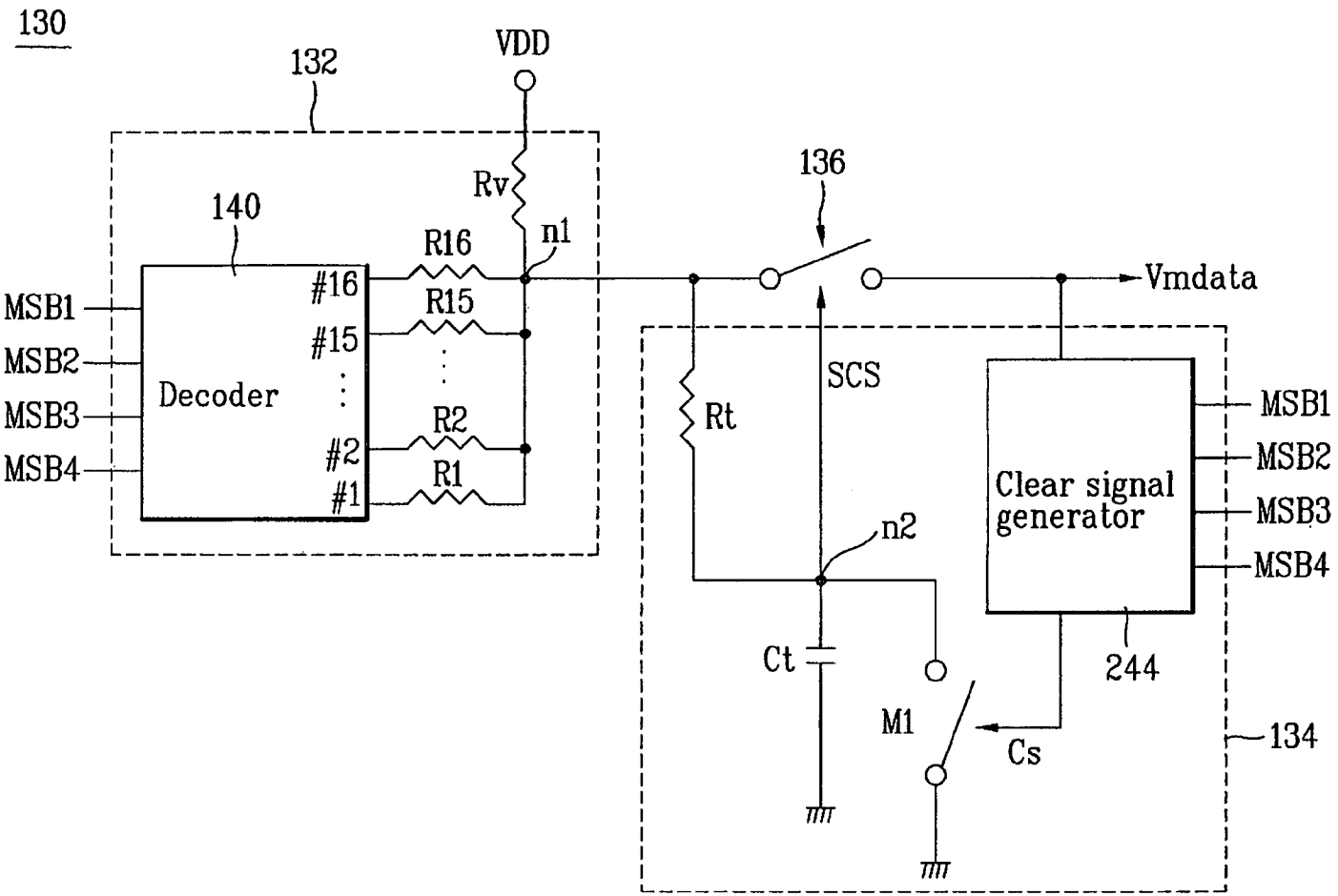
FIG. 11 is a view showing yet another example of the modulator in FIG. 6.

FIG. 11 shows a yet another example of the modulator 130 in the driving apparatus of the liquid crystal display device shown in FIGS. 5 and 6.

Referring to FIG. 11 in connection with FIG. 6, the modulator 130 may be similar in construction as that shown in FIG. 9. Therefore, a description will be omitted of similar components. As shown in FIG. 11, the modulator 130 may also include a switching control signal generator 134.

The switching control signal generator 134 of the modulator 130 includes a resistor Rt electrically connected between a first node n1, which is the output node of the modulated voltage generator 132, and a second node n2, which is a control terminal of the switch 136. The switching control signal generator 134 also includes a first capacitor Ct and a transistor M1 connected in parallel between the second node n2 and a ground voltage source. The switching control signal generator 134 further includes a clear signal generator 244 for decoding the modulated data voltage Vmdata outputted through the switch 136 according to the 4-most significant bit digital data signal (MSB1 to MSB4) from the latch 122 to generate a clear signal Cs for turning the transistor M1 on/off.

The resistor Rt supplies a voltage from the first node n1 to the second node n2. The first capacitor Ct constitutes an RC circuit with the resistor Rt to turn on a voltage at the second node n2, namely, the switch 136. As a result, while the first capacitor Ct is charged with a voltage from the RC circuit of the first capacitor Ct and resistor Rt, the switch 136 is turned on to supply the modulated data voltage Vmdata from the modulated voltage generator 132 to the mixer 126.

The transistor M1 electrically connects the second node n2 to the ground voltage source in response to the clear signal Cs from the clear signal generator 244 so as to discharge the voltage charged on the first capacitor Ct.

The clear signal generator 244 decodes the modulated data voltage Vmdata which is supplied to the mixer 126 through the switch 136, according to the 4-most significant bit digital data signal (MSB1 to MSB4) from the latch 122, to generate the clear signal Cs.

Figure 12:
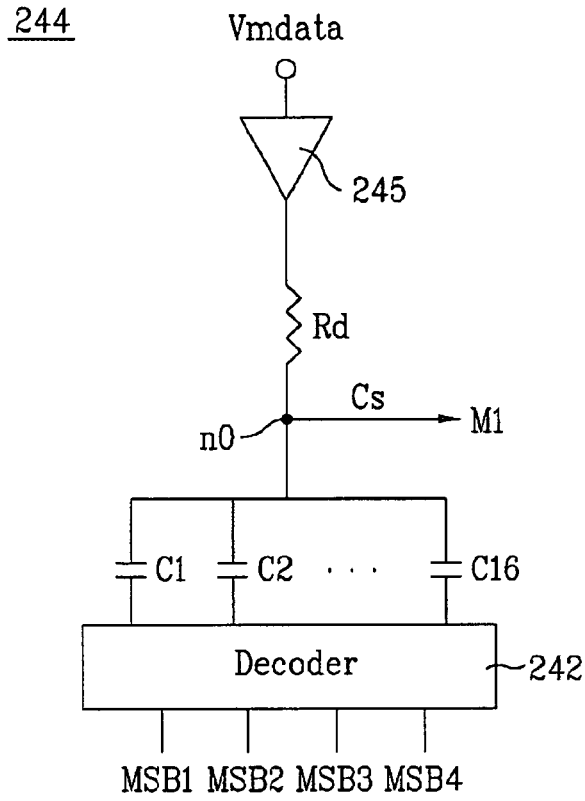
FIG. 12 is a view showing one example of a clear signal generator in FIG. 11.

As shown in FIG. 12, the clear signal generator 244 includes a buffer 245 for buffering the modulated data voltage Vmdata which is supplied to the mixer 126, a resistor Rd electrically connected between an output terminal n0 of the clear signal generator 244, which is connected to a control terminal of the transistor M1 and the buffer 245. The clear signal generator 244 also includes a plurality of second capacitors C1 to C16 connected in parallel to the output terminal n0, and a second decoder 242 for selecting any one of the second capacitors C1 to C16 according to the 4-most significant bit digital data signal (MSB1 to MSB4) from the latch 122.

The buffer 245 buffers the modulated data voltage Vmdata which is supplied to the mixer 126 through the switch 136, and supplies the buffered voltage to the resistor Rd.

Figure 13:
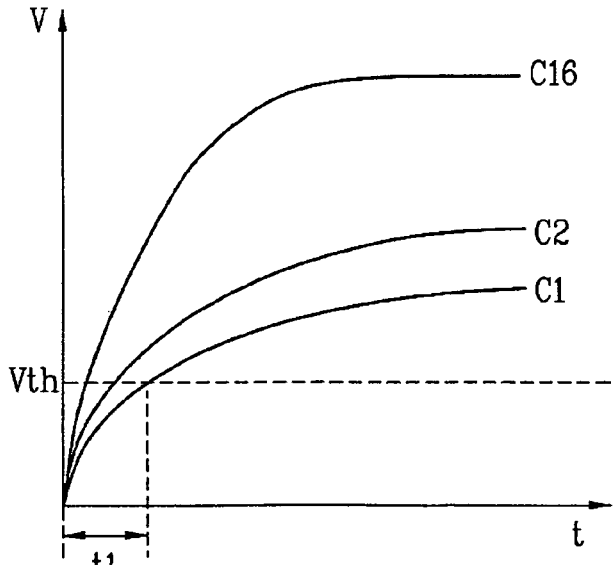
FIG. 13 is a waveform diagram of voltages stored in respective capacitors in FIG. 12.

Each of the second capacitors C1 to C16 has a first electrode electrically connected to the output terminal n0, and a second electrode electrically connected to the second decoder 242. These capacitors C1 to C16 have different capacitances, so that they have charging characteristics as shown in FIG. 13.

The second decoder 242 decodes the 4-most significant bit digital data signal (MSB1 to MSB4) from the latch 122 to selectively connect the second electrode of any one of the plurality of second capacitors C1 to C16 to an internal ground voltage source. As a result, the selectively connected second capacitor and the resistor Rt constitute an RC circuit.

With this configuration, the clear signal generator 244 selects any one of the second capacitors C1 to C16 according to the 4-most significant bit digital data signal (MSB1 to MSB4) from the latch 122 and connects the selected second capacitor to the ground voltage source, so as to charge the voltage inputted through the buffer 245 on the selected second capacitor. Thus, the clear signal generator 244 generates a clear signal Cs corresponding to the voltage charged on the second capacitor selected by the second decoder 242, and supplies the generated clear signal Cs to the transistor M1.

The clear signal Cs has a first logic state when the voltage charged on the selected one of the second capacitors C1 to C16 is lower than a threshold voltage Vth of the transistor M1, and a second logic state when the charged voltage is higher than or equal to the threshold voltage Vth of the transistor M1. Preferably, the second logic state has a voltage level capable of turning on the transistor M1, and the first logic state has a voltage level capable of turning off the transistor M1.

The transistor M1 discharges the voltage at the second node n2 to the ground voltage source by the clear signal Cs of the generated second logic state depending on the capacitance of each of the second capacitors C1 to C16. As a result, the switching control signal generator 134 sets the time t1 for which the modulated data voltage Vmdata is supplied to the mixer 126. The switching control signal generator 134 sets the time t1 by generating a switching control signal SCS with a different pulse width based on the clear signal Cs generated according to the 4-most significant bit digital data signal (MSB1 to MSB4).

Figure 14:
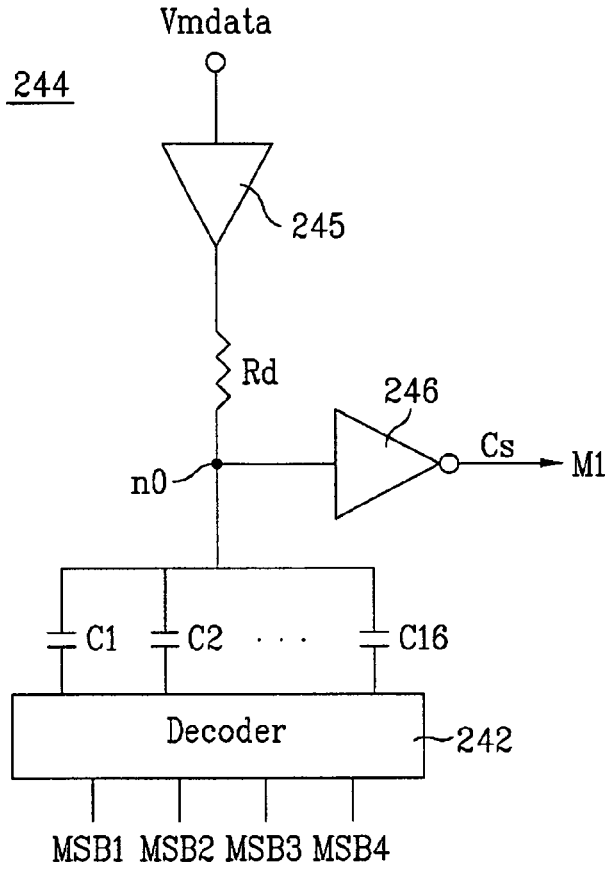
FIG. 14 is a view showing another example of the clear signal generator in FIG. 11.

Alternatively, the clear signal generator 244 may further include, as shown in FIG. 14, an inverter 246 connected between the output terminal n0 and the control terminal of the transistor M1.

The inverter 246 inverts the clear signal Cs from the output terminal n0 and supplies the inverted clear signal to the control terminal of the transistor M1. In one example, the transistor M1 may be a P type transistor.

In another alternative, the clear signal generator 244 may further include two inverters which are connected between the output terminal n0 and the control terminal of the transistor M1 to invert the clear signal Cs from the output terminal n0 two times and supply the non-inverted clear signal to the control terminal of the transistor M1. In this alternative, the transistor M1 may be an N type transistor.

Hence, the switching control signal generator 134 in the modulator 130 generates the clear signal Cs corresponding to the M-bit digital data signal Data to control the switch 136. As a result, a modulated data voltage Vmdata with a different level and different pulse width depending on the M-bit digital data signal Data is supplied to the mixer 126.

To clarify, the switching control signal generator 134 in the modulator 130, as shown in FIG. 11, turns on the switch 136 through the use of the first capacitor Ct and resistor Rt to supply a modulated data voltage Vmdata having a different pulse width and a level corresponding to the M-bit digital data signal Data to the mixer 126 in the first period t1 of the gate pulse GP. The switching control signal generator 134 also turns off the switch 136 by generating the clear signal Cs corresponding to the M-bit digital data signal Data to discharge the voltage stored in the first capacitor Ct in the second period t2 of the gate pulse GP.

Therefore, in the driving apparatus and method of the liquid crystal display device including the modulator 130 shown in FIG. 11, the liquid crystal is driven at high speed with a mixed data voltage. The mixed data voltage includes the modulated data voltage Vmdata and the analog data voltage Vdata. The modulated data voltage Vmdata has a fixed pulse width and a level corresponding to the M-bit digital data signal Data. The liquid crystal is driven at high speed with the mixed data voltage in the first period t1 of the scan period of the liquid crystal panel 102, and then normally driven with the analog data voltage Vdata in the second period t2 subsequent to the first period t1.

Figure 15:
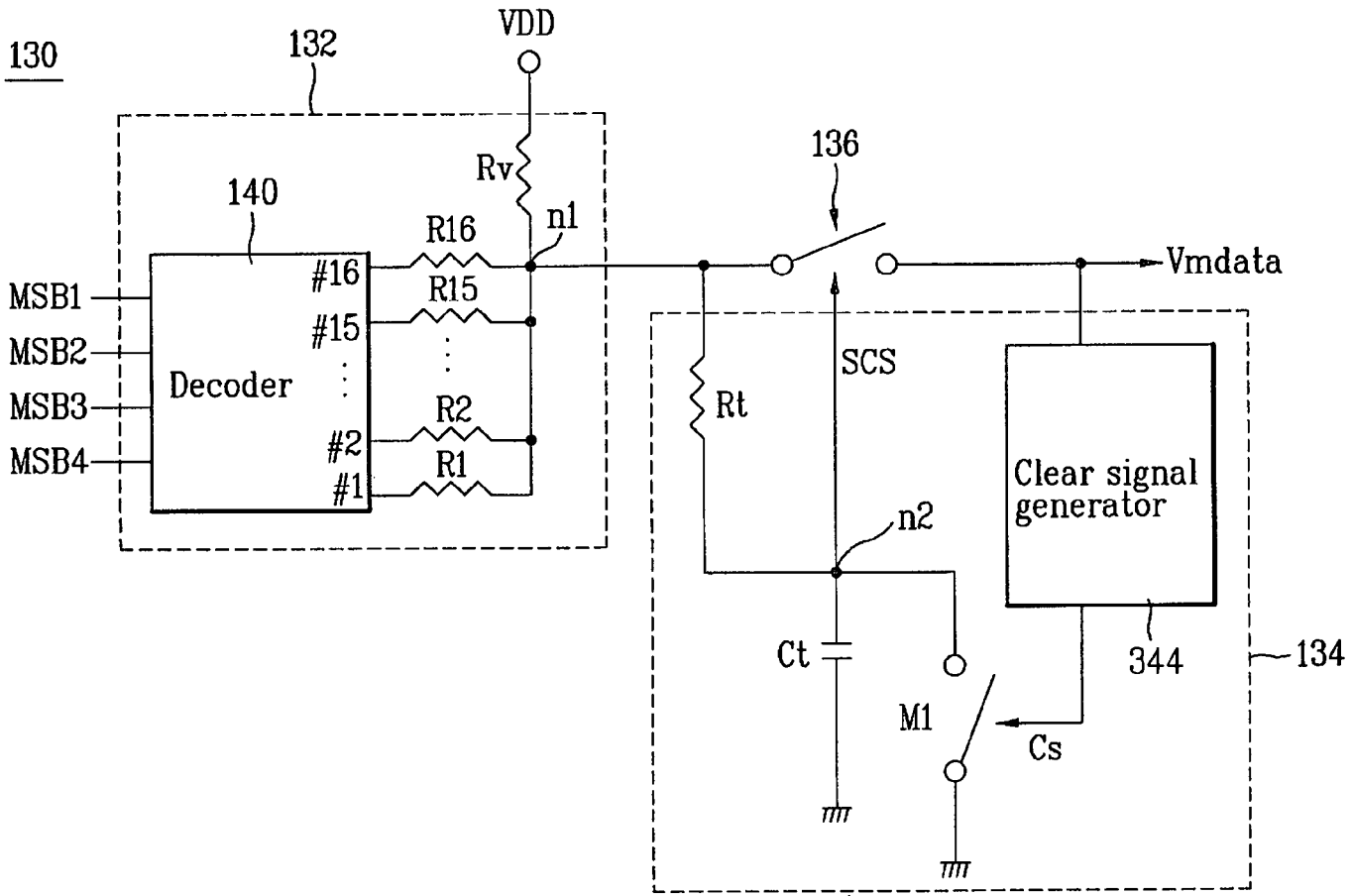
FIG. 15 is a view showing a fourth example of the modulator in FIG. 6.

FIG. 15 shows a fourth example of the modulator 130 in the driving apparatus of the liquid crystal display device shown in FIGS. 5 and 6.

Referring to FIG. 15 in connection with FIG. 6, the modulator 130 may be similar in construction as that shown in FIG. 9. Therefore, a description will be omitted of similar components. As shown in FIG. 15, the modulator 130 may also include a switching control signal generator 134.

The switching control signal generator 134 of the modulator 130 shown in FIG. 15 includes a resistor Rt electrically connected between a first node n1, which is the output node of the modulated voltage generator 132, and a second node n2, which is a control terminal of the switch 136. The switching control signal generator 134 also includes a first capacitor Ct and a transistor M1 connected in parallel between the second node n2 and a ground voltage source, and a clear signal generator 344 for generating a clear signal Cs for turning the transistor M1 on and off using the modulated data voltage Vmdata outputted through the switch 136.

The resistor Rt supplies a voltage from the first node n1 to the second node n2. The first capacitor Ct constitutes an RC circuit with the resistor Rt to turn on a voltage at the second node n2, namely, the switch 136. Thus, while a voltage is charged on the first capacitor Ct by the RC circuit of the first capacitor Ct and resistor Rt, the switch 136 is turned on to supply the modulated data voltage Vmdata from the modulated voltage generator 132 to the mixer 126.

The transistor M1 electrically connects the second node n2 to the ground voltage source in response to the clear signal Cs from the clear signal generator 344 so as to discharge the voltage charged on the first capacitor Ct.

The clear signal generator 344 generates the clear signal Cs for turning the transistor M1 on and off, using the modulated data voltage Vmdata which is supplied to the mixer 126 through the switch 136.

Figure 16:
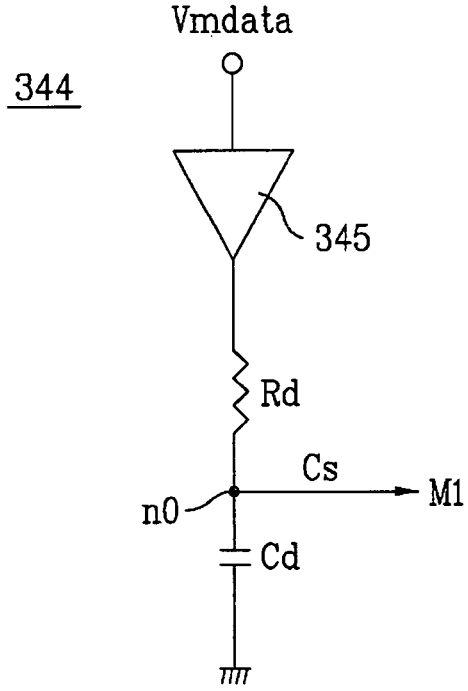
FIG. 16 is a view showing one example of a clear signal generator in FIG. 15.

As shown in FIG. 16, the clear signal generator 344 includes a buffer 345 for buffering the modulated data voltage Vmdata, a resistor Rd electrically connected between an output terminal n0 of the clear signal generator 344, which is connected to a control terminal of the transistor M1 and the buffer 345, and a second capacitor Cd electrically connected between the output terminal n0 and the ground voltage source.

The buffer 345 buffers the modulated data voltage Vmdata which is supplied to the mixer 126, and supplies the buffered voltage to the resistor Rd.

The resistor Rd and the second capacitor Cd function so as to delay the modulated data voltage Vmdata supplied from the buffer 345 by an RC time constant to generate the clear signal Cs, and to supply the generated clear signal Cs to the control terminal of the transistor M1. The RC time constant of the resistor Rd and second capacitor Cd is set to a value to turn the transistor M1 on by generating the clear signal Cs for the second period t2 of the gate pulse GP supplied to the gate line.

Alternatively, the clear signal generator 344 may further include at least one inverter connected between the output terminal n0 and the control terminal of the transistor M1.

In this arrangement, the switching control signal generator 134 in the modulator 130 turns on the switch 136 through the use of the first capacitor Ct and resistor Rt to supply a modulated data voltage Vmdata having a fixed pulse width and a level corresponding to the M-bit digital data signal Data to the mixer 126 in the first period t1 of the gate pulse GP. The switching control signal generator 134 also turns off the switch 136 by discharging the voltage stored in the first capacitor Ct in the second period t2 of the gate pulse GP through the use of the clear signal generator 344 and transistor M1.

Therefore, in the driving apparatus and method of the liquid crystal display device including the modulator 130 shown in FIG. 15, the liquid crystal is driven at high speed with a mixed data voltage. The mixed data voltage includes the modulated data voltage Vmdata and the analog data voltage Vdata. The modulated data voltage Vmdata has a fixed pulse width and a level corresponding to the M-bit digital data signal Data. The liquid crystal is driven at high speed with the mixed data voltage in the first period t1 of the scan period of the liquid crystal panel 102, and then normally driven with the analog data voltage Vdata in the second period t2 subsequent to the first period t1.

Figure 17:
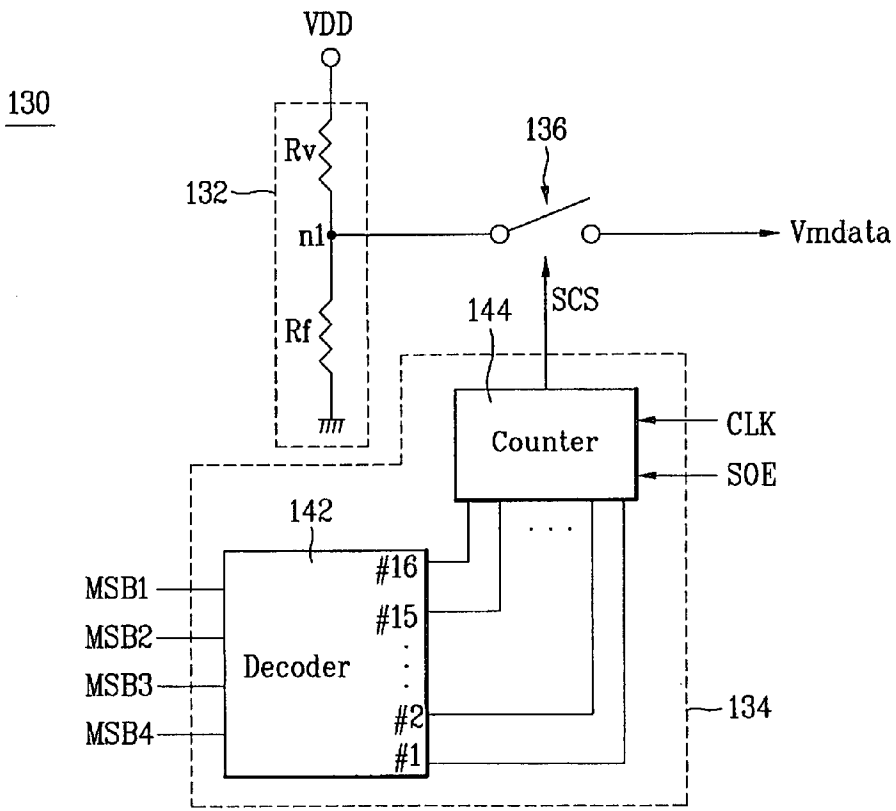
FIG. 17 is a view showing a fifth example of the modulator in FIG. 6.

FIG. 17 shows a fifth example of the modulator 130 in the driving apparatus of the liquid crystal display device according to the embodiment of the present invention shown in FIGS. 5 and 6.

Referring to FIG. 17 in connection with FIG. 6, the modulator 130 may be similar in construction as that shown in FIG. 9. Therefore, a description will be omitted of similar components. As shown in FIG. 17, the modulator 130 may also include a modulated voltage generator 132.

As shown in FIG. 17, the modulated voltage generator 132 of the modulator 130 includes first and second voltage-dividing resistors Rv and Rf connected in series between a drive voltage VDD and a ground voltage, and an output node n1 located between the first and second voltage-dividing resistors Rv and Rf and electrically connected to the switch 136.

The first and second voltage-dividing resistors Rv and Rf cooperate to divide the drive voltage VDD by their resistances and supply the divided voltage of a fixed level to the switch 136.

In this arrangement, the modulated voltage generator 132 of the modulator. 130 generates the modulated data voltage Vmdata of the fixed level through the use of the first and second voltage-dividing resistors Rv and Rf and supplies the generated data voltage to the switch 136.

Therefore, in the driving apparatus and method of the liquid crystal display device including the modulator 130 shown in FIG. 17, the liquid crystal is driven at high speed with the mixed data voltage. The mixed data voltage includes the modulated data voltage Vmdata and an analog data voltage Vdata. The modulated data voltage Vmdata has a level fixed regardless of the M-bit digital data signal Data and a pulse width based on the M-bit digital data signal Data. The liquid crystal is driven at high speed with the mixed data voltage in the first period t1 of the scan period of the liquid crystal panel 102, and then normally driven with the analog data voltage Vdata in the second period t2 subsequent to the first period t1.

Figure 18:
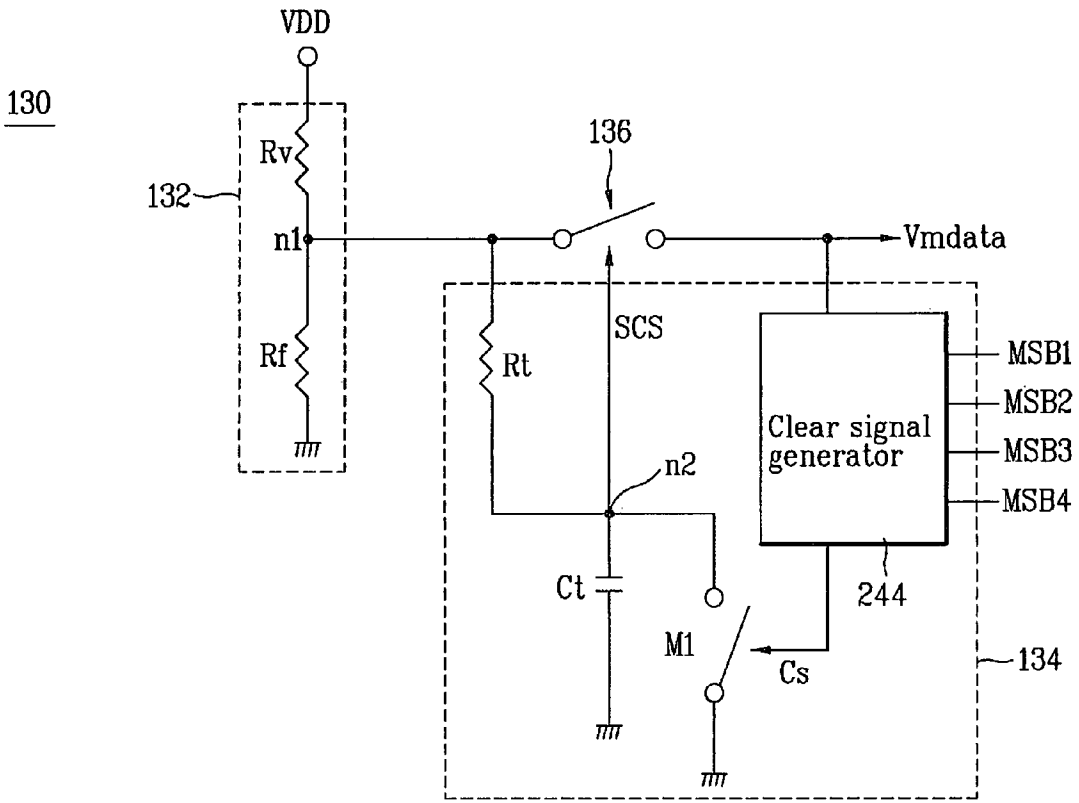
FIG. 18 is a view showing a sixth example of the modulator in FIG. 6.

FIG. 18 shows a sixth example of the modulator 130 in the driving apparatus of the liquid crystal display device shown in FIGS. 5 and 6.

Referring to FIG. 18 in connection with FIG. 6, the modulator 130 may be similar in construction as that shown in FIG. 11. Therefore, a description will be omitted of similar components. As shown in FIG. 18, the modulator 130 may also include a modulated voltage generator 132.

As shown in FIG. 18, the modulated voltage generator 132 of the modulator 130 includes first and second voltage-dividing resistors Rv and Rf connected in series between a drive voltage VDD and a ground voltage, and an output node n1 located between the first and second voltage-dividing resistors Rv and Rf and electrically connected to the switch 136.

The first and second voltage-dividing resistors Rv and Rf cooperate to divide the drive voltage VDD by their resistances and to supply the divided voltage of a fixed level to the switch 136.

In this arrangement, the modulated voltage generator 132 of the modulator 130 according to the sixth embodiment generates the modulated data voltage Vmdata of the fixed level through the use of the first and second voltage-dividing resistors Rv and Rf and supplies the generated data voltage to the switch 136.

Therefore, in the driving apparatus and method of the liquid crystal display device including the modulator 130 shown in FIG. 18, the liquid crystal is driven at high speed with the mixed data voltage. The mixed data voltage includes the modulated data voltage Vmdata and an analog data voltage Vdata. The modulated data voltage Vmdata has a level fixed regardless of the M-bit digital data signal Data and a pulse width based on the M-bit digital data signal Data. The liquid crystal is driven at high speed with the mixed data voltage in the first period t1 of the scan period of the liquid crystal panel 102, and then normally driven with the analog data voltage Vdata in the second period t2 subsequent to the first period t1.

Figure 19:
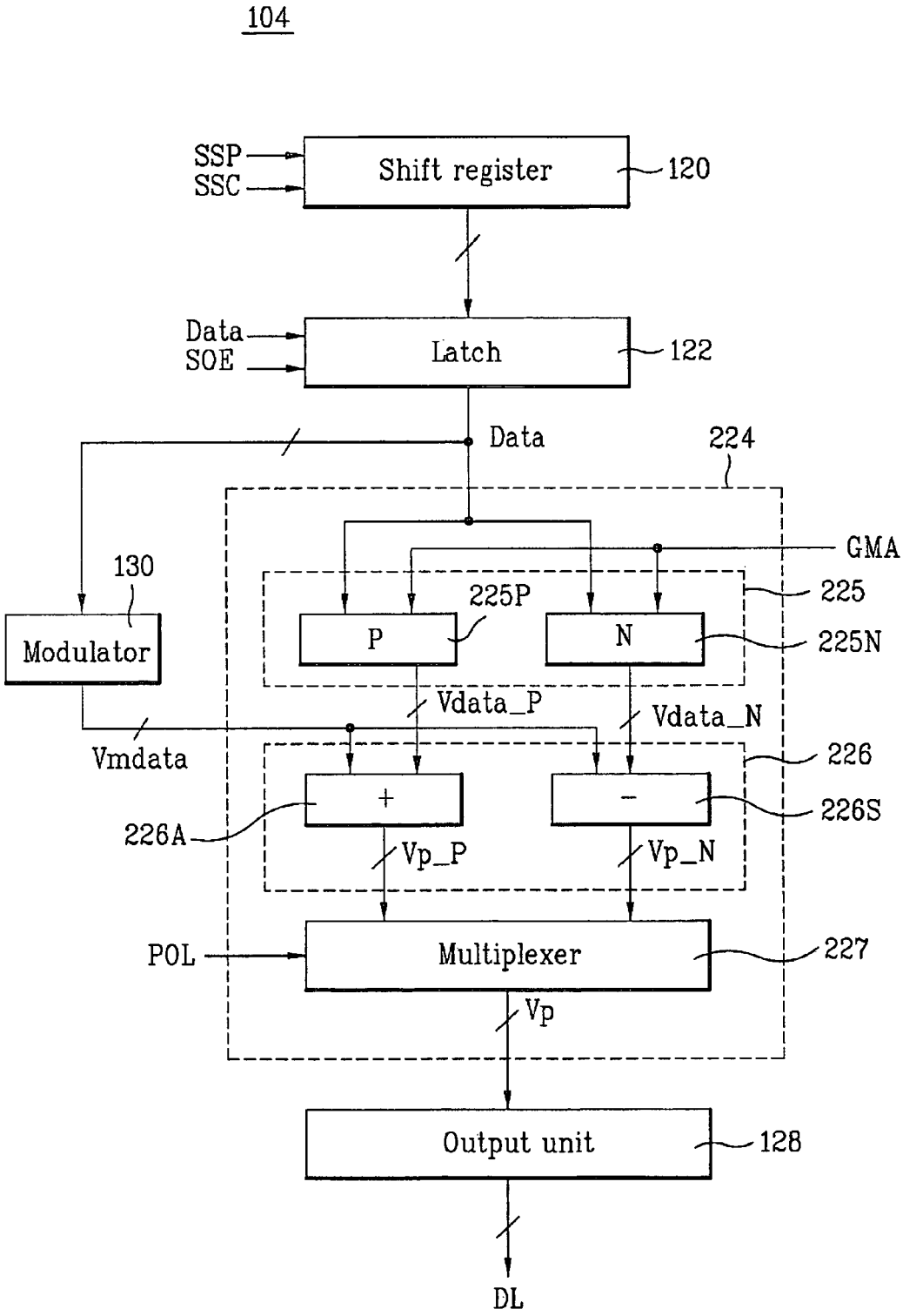
FIG. 19 is a block diagram showing another example of a data driver.

FIG. 19 is a block diagram showing another example of a data driver.

As shown in FIG. 19 with reference to FIG. 5, the data driver 104 comprises a shift register 120 that sequentially generates a sampling signal, a latch 122 that latches an N-bit digital data signal Data in response to the sampling signal, and a modulator 130 that generates a modulated data voltage Vmdata for accelerating the response speed of liquid crystal according to an M-bit data value from the latched N-bit digital data signal Data. The data driver 104 also includes a digital-to-analog converter 224 that generates an analog data voltage Vdata corresponding to the digital data signal Data by selecting any one of a plurality of gamma voltages GMA in response to the latched N-bit digital data signal Data, mixes the generated analog data voltage Vdata and the modulated data voltage Vmdata from the modulator 130, and outputs the mixed result. The data driver 104 further includes an output unit 128 that buffers the data voltage Vp mixed in the digital-to-analog converter 224 and supplies the buffered data voltage to data lines DL.

The shift register 120 sequentially generates and supplies the sampling signal to the latch 122 in response to a source start pulse SSP and a source shift clock SSC included in a data control signal DCS from a timing controller 108.

The latch 122 latches the N-bit digital data signal Data from the timing controller 108 in response to the sampling signal from the shift register 120 on a horizontal line-by-horizontal line basis. The latch 122 also supplies the latched N-bit digital data signal Data of one horizontal line to the digital-to-analog converter 224 in response to a source output enable signal SOE included in the data control signal DCS from the timing controller 108.

The modulator 130 generates the modulated data voltage Vmdata for accelerating the response speed of the liquid crystal according to the digital data signal Data of the M bits from the N bits outputted from the latch 122 and supplies the generated data voltage Vmdata to the digital-to-analog converter 224.

The digital-to-analog converter 224 comprises a decoder 225, a mixer 226, and a multiplexer 227. The decoder 225 generates positive (+) and negative (−) polarity analog data voltages (Vdata_P, Vdata_N) by decoding the N-bit digital data signal Data supplied from the latch 122. The mixer 226 mixes the positive (+) and negative (−) polarity analog data voltages (Vdata_P, Vdata_N) with the modulated data voltage Vmdata. The multiplexer 227 selects any one of the positive (+) and negative (−) polarity data voltages (Vp_P, Vp_N) mixed from the mixer 226 according to a polarity control signal POL, and supplies the selected voltage to the output unit 128.

Furthermore, the decoder 225 comprises a positive polarity decoder 225P for generating the positive analog data voltage Vdata_P, and a negative polarity decoder 225N for generating the negative analog data voltage Vdata_N.

The positive polarity decoder 225P generates the positive analog data voltage Vdata_P by decoding any one of the plurality of positive polarity gamma voltages GMA according to the N-bit digital data signal Data, and supplies the generated positive analog data voltage Vdata_P to the mixer 226.

The negative polarity decoder 225N generates the negative analog data voltage Vdata_N by decoding any one of the plurality of negative polarity gamma voltages GMA according to the N-bit digital data signal Data, and supplies the generated negative analog data voltage Vdata_N to the mixer 226.

The mixer 226 comprises an adding part 226A for generating the positive data voltage Vp_P, and a subtracting part 226S for generating the negative data voltage Vp_N.

Figure 20A:
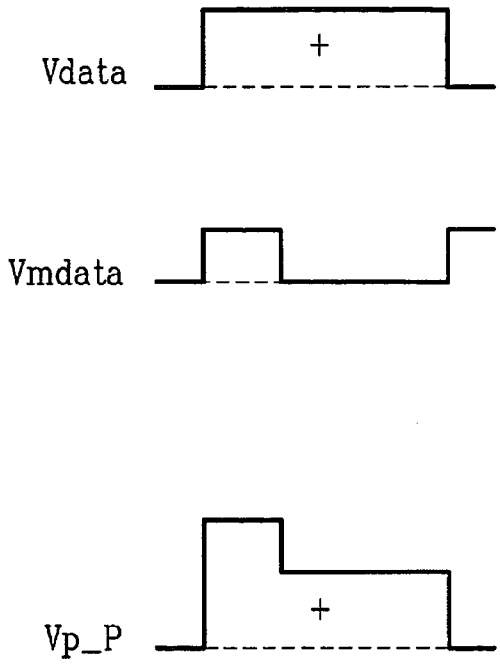
FIG. 20A is a waveform diagram of a mix of a modulated data voltage and a positive analog data voltage shown in FIG. 19.

As shown in FIG. 20A, the adding part 226A generates the positive data voltage Vp_P by adding the modulated data voltage Vmdata and the positive analog data voltage Vdata_P from the positive polarity decoder 225P.

Figure 20B:
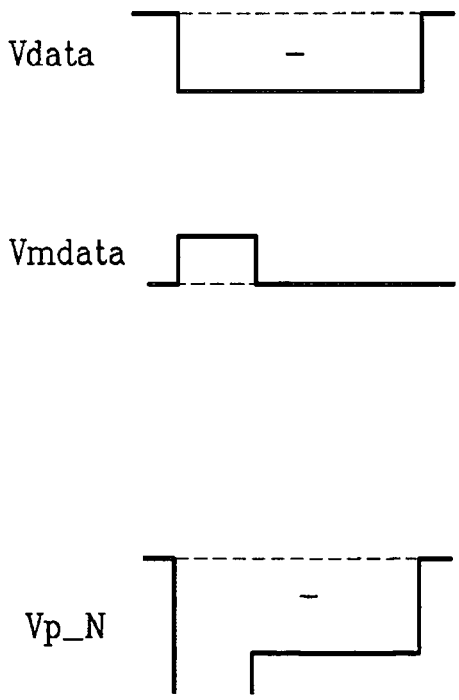
FIG. 20B is a waveform diagram of a mix of a modulated data voltage and a negative analog data voltage shown in FIG. 19.

As shown in FIG. 20B, the subtracting part 226S generates the negative data voltage Vp_N by subtracting the modulated data voltage Vmdata from the negative analog data voltage Vdata_N from the negative polarity decoder 225N.

The multiplexer 227 selects any one of the positive and negative data voltages (Vp_P, Vp_N) supplied from the adding part 226A and the subtracting part 226S of the mixer 226 according to the polarity control signal POL included in the data control signal DCS supplied from the timing controller 108, and supplies the selected one to the output unit 128.

The output unit 128 applies the data voltage Vp supplied from the multiplexer 227 of the digital-to-analog converter 224 to the corresponding data lines DL.

Figure 21:
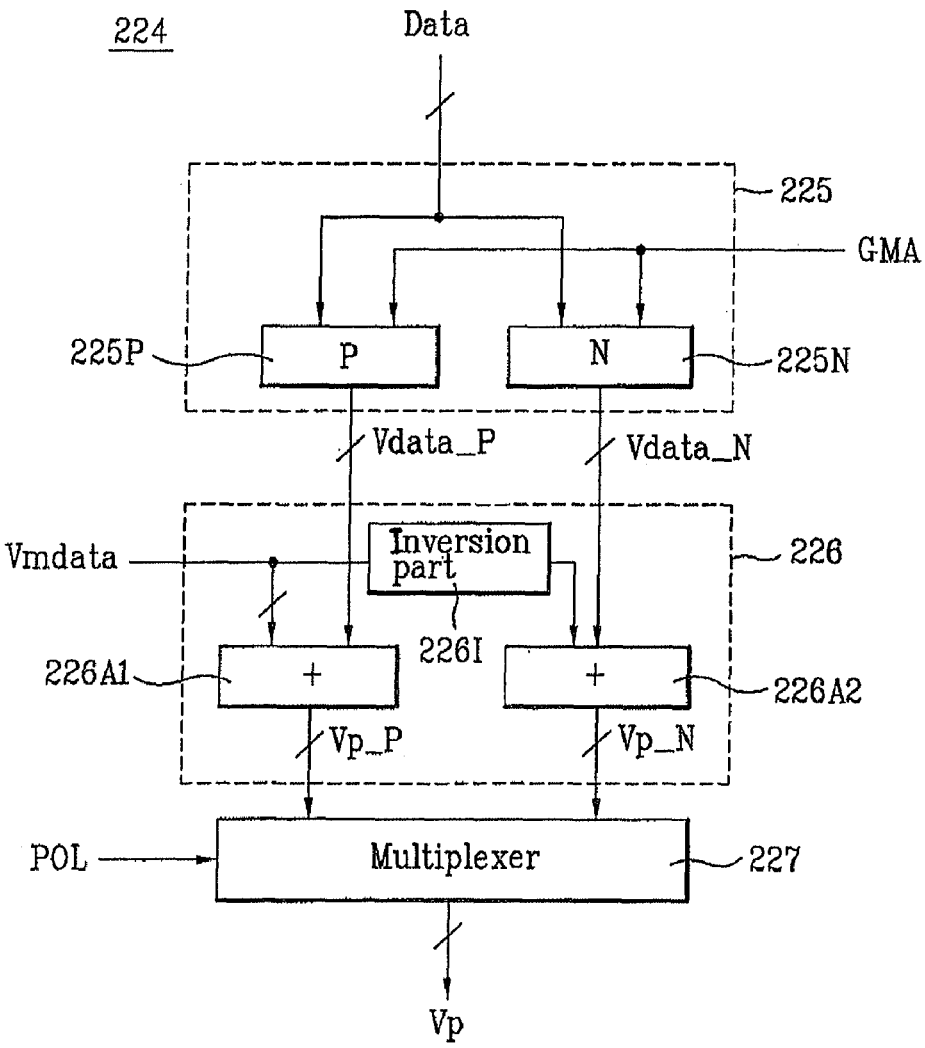
FIG. 21 is a block diagram of another example of a digital-to-analog converter.

FIG. 21 is a block diagram showing another example of a digital-to-analog converter 224.

As shown in FIG. 21 with reference to FIG. 19, the digital-to-analog converter 224 comprises a decoder 225, a mixer 226, and a multiplexer 227. The decoder 225 generates positive (+) and negative (−) polarity analog data voltages (Vdata_P, Vdata_N) by decoding the N-bit digital data signal Data supplied from the latch 122. The mixer 226 also mixes the positive (+) and negative (−) polarity analog data voltages (Vdata_P, Vdata_N) with the modulated data voltage Vmdata supplied from the modulator 130. Then, the multiplexer 227 selects any one of the positive (+) and negative (−) polarity data voltages (Vp_P, Vp_N) mixed from the mixer 226 according to a polarity control signal POL, and supplies the selected one to the output unit 128.

Furthermore, the decoder 225 comprises a positive polarity decoder 225P for generating the positive analog data voltage Vdata_P, and a negative polarity decoder 225N for generating the negative analog data voltage Vdata_N.

The positive polarity decoder 225P generates the positive analog data voltage Vdata_P by decoding any one of the plurality of positive polarity gamma voltages GMA according to the N-bit digital data signal Data, and supplies the generated positive analog data voltage Vdata_P to the mixer 226.

The negative polarity decoder 225N generates the negative analog data voltage Vdata_N by decoding any one of the plurality of negative polarity gamma voltages GMA according to the N-bit digital data signal Data, and supplies the generated negative analog data voltage Vdata_N to the mixer 226.

The mixer 226 comprises a first adding part 226A1 for generating the positive data voltage Vp_P by using the modulated data voltage Vmdata, an inversion part 226I for inverting the polarity of the modulated data voltage Vmdata, and a second adding part 226A2 for generating the negative data voltage Vp_N by using the modulated data voltage Vmdata, which is inversed by the inversion part 226I.

As shown in FIG. 21, the first adding part 226A1 generates the positive data voltage Vp_P by adding the modulated data voltage Vmdata and the positive analog data voltage Vdata_P from the positive polarity decoder 225P.

Figure 22:
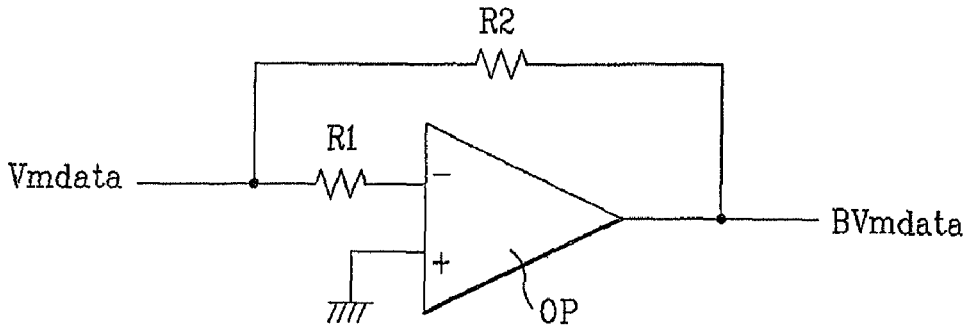
FIG. 22 is a circuit diagram of an inversion part of FIG. 21.

The inversion part 226I inverts the polarity of the modulated data voltage Vmdata supplied from the modulator 130, and supplies the modulated data voltage of the inverted polarity to the second adding part 226A2. As shown in FIG. 22, the inversion part 226I comprises an inversion amplifier OP.

To invert the polarity of the modulated data voltage Vmdata, the modulated data voltage Vmdata is supplied to an inversion terminal (−) of the inversion amplifier OP, and a ground voltage is supplied to a non-inversion terminal (+) of the inversion amplifier OP. A feedback loop is also located between the non-inversion terminal (+) and the inversion terminal (−) in the inversion amplifier OP.

Figure 23:
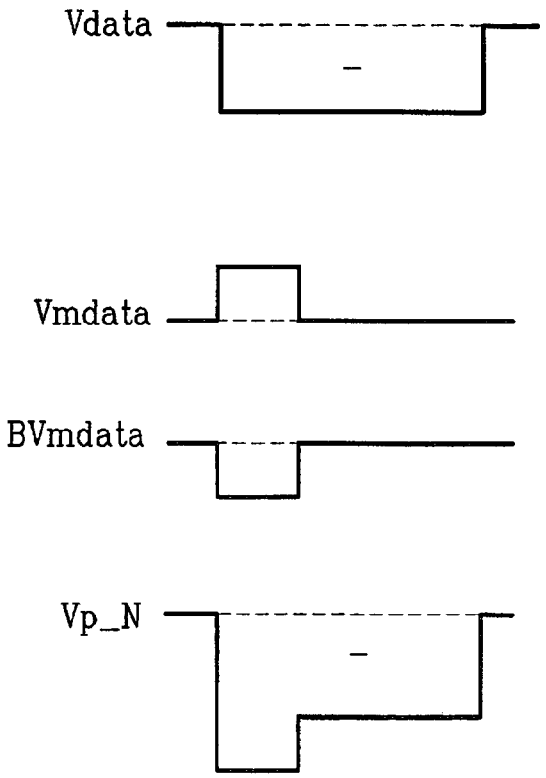
FIG. 23 is a waveform diagram of a mix of a modulated data voltage and a negative analog data voltage shown in FIG. 21.

As shown in FIG. 23, the second adding part 226A2 generates the negative data voltage Vp_N by adding the modulated data voltage of the inverted polarity BVmdata supplied from the inversion part 226I and the negative analog data voltage Vdata_N supplied from the negative polarity decoder 225N.

The multiplexer 227 selects any one of the positive and negative data voltages (Vp_P, Vp_N) supplied from the first and second adding parts 226A1 and 226A2 according to the polarity control signal POL included in the data control signal DCS supplied from the timing controller 108, and supplies the selected one to the output unit 128.

Thus, a driving apparatus and method of a liquid crystal display device is described in which a liquid crystal is pre-driven with a modulated data voltage higher than an analog data voltage corresponding to a digital data signal by supplying a data voltage including the modulated data voltage to a data line in a first period of a gate pulse which is supplied to a gate line, and then driven in a desired state by supplying an analog data voltage of a desired gray scale to the data line in a second period of the gate pulse.

Therefore, according to the disclosed driving apparatus and method of the liquid crystal display device, it is possible to increase the response speed of the liquid crystal without using a separate memory, so as to prevent degradation in picture quality. Furthermore, because a separate memory is not used, it is possible to decrease the cost of the liquid crystal display.

It will be apparent to those skilled in the art that various modifications and variations can be made without departing from the spirit or scope of the disclosure. Thus, it is intended that this disclosure covers the modifications and variations of this according to the scope of the appended claims and their equivalents.

What is claimed is:

1. An apparatus for driving a liquid crystal display device, comprising:

a liquid crystal panel including a plurality of gate lines and a plurality of data lines arranged perpendicularly to each other;

a gate driver that supplies a gate pulse having a scan period to the gate lines, the scan period having a first period and a second period; and a data driver that samples an input N-bit (where N is a positive integer) digital data signal to generate positive (+) and negative (−) polarity analog data voltages, generates a modulated data voltage according to an M-bit (where M is a positive integer smaller than or equal to N) data value of the sampled digital data signal, outputs a positive data voltage higher than the positive (+) polarity analog data voltage and negative data voltage lower than the negative (−) polarity analog data voltage, and supplies the positive and negative data voltages to the data lines in the first period of the gate pulse and supplies the analog data voltage to the data lines in the second period of the gate pulse, wherein the data driver comprises:

a shift register that generates a sampling signal;

a latch that latches the N-bit digital data signal in response to the sampling signal and outputs the latched N-bit digital data signal in response to a data output enable signal;

a modulator that generates the modulated data voltage in the first period of the gate pulse according to the M-bit digital data signal outputted from the latch, wherein the first period of the gate pulse is shorter than the second period of the gate pulse; and a digital/analog converter that converts the N-bit digital data signal from the latch into the analog data voltage, generates the positive and negative data voltages by mixing the analog data voltage and the modulated data voltage, and outputs the positive and negative data voltages to data lines according a polarity control signal;

wherein the digital/analog converter comprises:

a positive polarity decoder that generates the positive (+) polarity analog data voltage by decoding the N-bit digital data signal supplied from the latch;

a negative polarity decoder that generates negative polarity analog data voltage by decoding the N-bit digital data signal supplied from the latch;

a mixer having a positive data voltage generator connected to output terminals of the positive polarity decoder and the modulator and a negative data voltage generator connected to output terminals of the negative polarity decoder and the modulator, wherein the positive data voltage generator generates the positive data voltage by mixing the positive (+) polarity analog data voltages with the modulated data voltage and the negative data voltage generator generates the negative data voltage by subtracting the modulated data voltage from the negative (−) polarity analog data voltages; and a multiplexer that selects any one of the positive and negative data voltages according to a polarity control signal, and outputs the selected one to the data lines.

2. The apparatus as set forth in claim 1, wherein the modulated data voltage has at least one of modulated voltage level and pulse width according to the M-bit digital data signal.

3. The apparatus as set forth in claim 1, wherein the modulator comprises:

a modulated voltage generator that sets a level of the modulated data voltage;

a switching control signal generator that generates a switching control signal to set a pulse width of the modulated data voltage; and a switch that supplies the modulated data voltage from the modulated voltage generator to the mixer in response to the switching control signal.

4. The apparatus as set forth in claim 3, wherein the modulated voltage generator comprises:

a first decoder that decodes the M-bit digital data signal to generate a first decoded signal;

a first resistor connected between a drive voltage terminal and an output node of the modulated voltage generator; and a plurality of voltage-dividing resistors connected between the output node of the modulated voltage generator and the first decoder dividing a drive voltage from the drive voltage terminal in response to the first decoded signal to vary a voltage level of the output node of the modulated voltage generator.

5. The apparatus as set forth in claim 3, wherein the modulated voltage generator includes first and second resistors connected between a drive voltage terminal and a ground voltage source dividing a drive voltage from the drive voltage terminal into the modulated data voltage of a fixed level by resistances thereof and supplying the divided voltage to the switch.

6. The apparatus as set forth in claim 3, wherein the switching control signal generator comprises:

a second decoder that decodes the M-bit digital data signal to generate a second decoded signal; and a counter that counts an input clock signal by the second decoded signal to generate the switching control signal with a different pulse width, and supplies the generated switching control signal to the switch.

7. The apparatus as set forth in claim 6, wherein the switching control signal is supplied to the switch synchronously with the data output enable signal or the gate pulse.

8. The apparatus as set forth in claim 3, wherein the switching control signal generator includes a counter that counts an input clock signal by a predetermined value to generate the switching control signal with a fixed pulse width, and supplies the generated switching control signal to the switch.

9. The apparatus as set forth in claim 8, wherein the switching control signal is supplied to the switch synchronously with the data output enable signal or the gate pulse.

10. The apparatus as set forth in claim 3, wherein the switching control signal generator comprises:

a resistor connected between an output node of the modulated voltage generator and a control terminal of the switch;

a capacitor connected between the control terminal of the switch and a ground voltage source that generates the switching control signal;

a clear signal generator that decodes the modulated data voltage outputted through the switch according to the M-bit digital data signal to generate a clear signal; and a transistor disposed between the control terminal of the switch and the ground voltage source that discharges a voltage stored in the capacitor in response to the clear signal.

11. The apparatus as set forth in claim 10, wherein the clear signal generator comprises:

a buffer that buffers the modulated data voltage;

a resistor connected between an output terminal of the clear signal generator, which is connected to a control terminal of the transistor, and the buffer;

a plurality of capacitors connected in parallel to the output terminal; and a second decoder that selects at least one of the plurality of capacitors according to the M-bit digital data signal.

12. The apparatus as set forth in claim 11, wherein the clear signal generator further includes an inverter connected between the output terminal and the control terminal of the transistor.

13. The apparatus as set forth in claim 3, wherein the switching control signal generator comprises:

a resistor connected between an output node of the modulated voltage generator and a control terminal of the switch;

a capacitor connected between the control terminal of the switch and a ground voltage source that generates the switching control signal;

a clear signal generator that generates a clear signal using the modulated data voltage outputted through the switch; and a transistor disposed between the control terminal of the switch and the ground voltage source that discharges a voltage stored in the capacitor in response to the clear signal.

14. The apparatus as set forth in claim 13, wherein the clear signal generator comprises:

a buffer that buffers the modulated data voltage;

a resistor connected between an output terminal of the clear signal generator, which is connected to a control terminal of the transistor, and the buffer; and a capacitor connected between the output terminal and the ground voltage source.

15. The apparatus as set forth in claim 14, wherein the clear signal generator further includes an inverter connected between the output terminal and the control terminal of the transistor.

16. The apparatus as set forth in claim 1, wherein the positive data voltage generator comprises an adding part that generates the positive data voltage by adding the modulated data voltage and the positive analog data voltage; and wherein the negative data voltage generator comprises a subtracting part that generates the negative data voltage by subtracting the modulated data voltage from the negative analog data voltage.

17. The apparatus as set forth in claim 1, wherein the positive data voltage generator comprises a first adding part for generating the positive data voltage by adding the modulated data voltage and the positive analog data voltage; and wherein the negative data voltage generator comprises:

an inversion part for inverting the polarity of the modulated data voltage; and a second adding part for generating the negative data voltage by adding the modulated data voltage of the inverted polarity and the negative analog data voltage.

18. The apparatus as set forth in claim 17, wherein the inversion part is formed of an inversion amplifier.

* * * * *